US008118473B2

(12) United States Patent
Compton et al.

(10) Patent No.: US 8,118,473 B2
(45) Date of Patent: Feb. 21, 2012

(54) SYSTEM FOR CALCULATING AND REPORTING SLUMP IN DELIVERY VEHICLES

(75) Inventors: John I Compton, West Chester, KY (US); Roy Cooley, West Chester, OH (US); Michael Topputo, Hamilton, OH (US)

(73) Assignee: Verifi, LLC, West Chester, OH (US)

( * ) Notice: Subject to any disclaimer, the term of this patent is extended or adjusted under 35 U.S.C. 154(b) by 1236 days.

(21) Appl. No.: 10/599,130

(22) PCT Filed: Feb. 14, 2005

(86) PCT No.: PCT/US2005/004405

§ 371 (c)(1), (2), (4) Date: Sep. 20, 2006

(87) PCT Pub. No.: WO2005/080058

PCT Pub. Date: Sep. 1, 2005

(65) Prior Publication Data

US 2007/0185636 A1 Aug. 9, 2007

Related U.S. Application Data

(60) Provisional application No. 60/544,720, filed on Feb. 13, 2004.

(51) Int. Cl.
*B28C 7/12* (2006.01)

(52) U.S. Cl. ..... 366/17; 366/34; 700/265

(58) Field of Classification Search ..... 366/29, 366/43, 1–8, 53–63, 142–143, 219–240, 366/16, 17, 19, 34, 40

See application file for complete search history.

(56) References Cited

U.S. PATENT DOCUMENTS 1,328,765 A * 1/1920 Robb ..... 366/29
1,410,126 A * 3/1922 Rosendahl ..... 366/43
1,781,549 A * 11/1930 Johnson et al. ..... 366/29
2,273,750 A * 2/1942 Clagett, Jr. ..... 73/54.03

(Continued)

FOREIGN PATENT DOCUMENTS

CA 2246191 A1 3/1999

(Continued)

OTHER PUBLICATIONS

International Bureau of WIPO, Preliminary Search Report and Written Opinion for PCT/US2005/004405 reported Aug. 14, 2006.

(Continued)

*Primary Examiner* — Charles E Cooley
(74) *Attorney, Agent, or Firm* — Wood, Herron & Evans, LLP

(57) ABSTRACT

A system for calculating and reporting slump in a delivery vehicle having a mixing drum (14) and hydraulic drive (16) for rotating the mixing drum, including a rotational sensor (20) configured to sense a rotational speed of the mixing drum, a hydraulic sensor (22) coupled to the hydraulic drive and configured to sense a hydraulic pressure required to turn the mixing drum, and a communications port (26) configured to communicate a slump calculation to a status system (28) commonly used in the concrete industry, wherein the sensing of the rotational speed of the mixing drum is used to qualify a calculation of current slump based on the hydraulic pressure required to turn the mixing drum.

10 Claims, 19 Drawing Sheets

U.S. PATENT DOCUMENTS

| | | | | | |
|---|---|---|---|---|---|
| 2,543,883 | A * | 3/1951 | Von Saspe | 137/552 |
| 3,593,966 | A * | 7/1971 | Munroe | 366/40 |
| 3,731,909 | A * | 5/1973 | Johnson | 366/61 |
| 3,924,447 | A * | 12/1975 | Garrison | 73/54.03 |
| 4,008,093 | A * | 2/1977 | Kitsuda et al. | 106/638 |
| 4,097,925 | A * | 6/1978 | Butler, Jr. | 366/2 |
| 4,318,177 | A | 3/1982 | Rapp et al. | |
| 4,356,723 | A * | 11/1982 | Fay | 73/54.03 |
| 4,544,275 | A * | 10/1985 | Hudelmaier | 366/30 |
| 4,585,356 | A * | 4/1986 | Hudelmaier | 366/60 |
| 4,846,581 | A * | 7/1989 | Osterlund et al. | 366/61 |
| 4,900,154 | A | 2/1990 | Waitzinger et al. | |
| 5,149,192 | A * | 9/1992 | Hamm et al. | 366/8 |
| 5,707,474 | A * | 1/1998 | Andersen et al. | 156/257 |
| 5,713,663 | A | 2/1998 | Zandberg et al. | |
| 5,752,768 | A | 5/1998 | Assh | |
| 5,895,116 | A | 4/1999 | Kreinheder et al. | |
| 6,042,258 | A * | 3/2000 | Hines et al. | 366/8 |
| 6,042,259 | A * | 3/2000 | Hines et al. | 366/17 |
| 6,126,307 | A * | 10/2000 | Black et al. | 366/43 |
| 6,224,250 | B1 | 5/2001 | Kreinheder et al. | |
| 6,227,039 | B1 | 5/2001 | Te'eni | |
| 6,286,987 | B1 * | 9/2001 | Goode et al. | 366/60 |
| 6,484,079 | B2 | 11/2002 | Buckelew et al. | |
| 6,805,478 | B2 * | 10/2004 | Aizawa et al. | 366/1 |
| 6,862,521 | B1 | 3/2005 | Fox | |
| 6,876,904 | B2 * | 4/2005 | Oberg et al. | 700/265 |
| 7,384,180 | B2 * | 6/2008 | Jarvinen et al. | 366/2 |
| 7,386,368 | B2 * | 6/2008 | Andersen et al. | 700/265 |
| 7,489,993 | B2 * | 2/2009 | Coffee et al. | 701/35 |
| 7,530,728 | B2 * | 5/2009 | Rosaen | 366/17 |
| 7,722,243 | B2 * | 5/2010 | Schumacher et al. | 366/3 |
| 7,722,244 | B2 * | 5/2010 | Panuccio | 366/8 |
| 7,729,831 | B2 * | 6/2010 | Pillar et al. | 701/48 |
| 7,835,838 | B2 * | 11/2010 | Pillar et al. | 701/50 |
| 7,950,841 | B2 * | 5/2011 | Klein et al. | 366/4 |
| 8,020,431 | B2 * | 9/2011 | Cooley et al. | 366/142 |
| 2002/0015354 | A1 * | 2/2002 | Buckelew | 366/2 |
| 2002/0032517 | A1 * | 3/2002 | Buckelew et al. | 701/204 |
| 2002/0048212 | A1 * | 4/2002 | Hill et al. | 366/8 |
| 2004/0218462 | A1 * | 11/2004 | Stephens | 366/17 |
| 2005/0004733 | A1 * | 1/2005 | Pillar et al. | 701/48 |
| 2005/0159843 | A1 * | 7/2005 | Oberg et al. | 700/265 |
| 2006/0287773 | A1 * | 12/2006 | Andersen et al. | 700/265 |
| 2007/0185636 | A1 * | 8/2007 | Cooley et al. | 701/50 |
| 2007/0247964 | A1 * | 10/2007 | Ross et al. | 366/61 |
| 2007/0263478 | A1 * | 11/2007 | Burch | 366/61 |
| 2008/0009976 | A1 * | 1/2008 | Andersen et al. | 700/265 |
| 2008/0027583 | A1 * | 1/2008 | Andersen et al. | 700/265 |
| 2008/0027584 | A1 * | 1/2008 | Andersen et al. | 700/265 |
| 2008/0144424 | A1 * | 6/2008 | Schumacher et al. | 366/3 |
| 2008/0316856 | A1 * | 12/2008 | Cooley et al. | 366/142 |
| 2009/0037026 | A1 * | 2/2009 | Sostaric et al. | 700/265 |
| 2009/0064903 | A1 * | 3/2009 | Buesing et al. | 106/706 |
| 2009/0231949 | A1 * | 9/2009 | Rosaen | 366/19 |
| 2009/0292572 | A1 * | 11/2009 | Alden et al. | 705/7 |
| 2010/0312406 | A1 * | 12/2010 | Cooley et al. | 700/285 |
| 2010/0312438 | A1 * | 12/2010 | Cooley et al. | 701/50 |
| 2011/0004332 | A1 * | 1/2011 | Andersen | 700/103 |
| 2011/0004333 | A1 * | 1/2011 | Andersen | 700/103 |
| 2011/0029134 | A1 * | 2/2011 | Hazrati et al. | 700/265 |
| 2011/0077778 | A1 * | 3/2011 | Berman | 700/265 |

FOREIGN PATENT DOCUMENTS

| | | | |
|---|---|---|---|
| DE | 3539550 | A1 * | 6/1986 |
| DE | 4237543 | A1 * | 5/1994 |
| DE | 4437970 | A1 * | 5/1996 |
| EP | 0126573 | | 11/1984 |
| EP | 1184353 | A1 * | 3/2002 |
| GB | 2329027 | A * | 3/1999 |
| GB | 2392502 | A * | 3/2004 |
| GB | 2426347 | A * | 11/2006 |
| JP | 59016531 | A * | 1/1984 |
| JP | 01045605 | A * | 2/1989 |
| WO | WO 02/094526 | A1 * | 11/2002 |
| WO | WO 2008157690 | A2 * | 12/2008 |
| WO | WO 2009144523 | A2 * | 12/2009 |

OTHER PUBLICATIONS

Shepherdson, Robin: "Touch screen batch plant makes Con casts's pipe production go round"; Concrete Plant International, Issue Feb. 2002.

Scale-Tron Inc.; "MixTron II mixer water dosing"; product pamphlet.

Ultacontrol; "Introducing the all New Ultameter Digital Central Mix Concrete Slump Meter and Slump Control"; product pamphlet, copyright 2000.

Hugh Wang et al., Interaction of Materials Used in Concrete, Concrete International, Apr. 2006, pp. 47-52.

Dirk Lowke et al., Effect of Mixing Energy on Fresh Properties of SCC, Paper, Technical University of Munich, Centre of Building Materials.

* cited by examiner

SYSTEM FOR CALCULATING AND REPORTING SLUMP IN DELIVERY VEHICLES

FIELD OF THE INVENTION

The present invention generally relates to delivery vehicles and particularly to mobile concrete mixing trucks that mix and deliver concrete. More specifically, the present invention relates to the calculation and reporting of slump using sensors associated with a concrete truck.

BACKGROUND OF THE INVENTION

Hitherto it has been known to use mobile concrete mixing trucks to mix concrete and to deliver that concrete to a site where the concrete may be required. Generally, the particulate concrete ingredients are loaded at a central depot. A certain amount of liquid component may be added at the central depot. Generally the majority of the liquid component is added at the central depot, but the amount of liquid is often adjusted. The adjustment is often unscientific—the driver add water from any available water supply (sometimes there is water on the truck) by feeding a hose directly into the mixing barrel and guessing as to the water required. Operators attempt to tell by experience the correct or approximate volume of water to be added according to the volume of the particulate concrete ingredients. The adding of the correct amount of liquid component is therefore usually not precise.

It is known, that if concrete is mixed with excess liquid component, the resulting concrete mix does not dry with the required structural strength. At the same time, concrete workers tend to prefer more water, since it makes concrete easier to work. Accordingly, slump tests have been devised so that a sample of the concrete mix can be tested with a slump test prior to actual usage on site. Thus, if a concrete mixing truck should deliver a concrete mix to a site, and the mix fails a slump test because it does not have sufficient liquid component, extra liquid component may be added into the mixing barrel of the concrete mixing truck to produce a required slump in a test sample prior to actual delivery of the full contents of the mixing barrel. However, if excess water is added, causing the mix to fail the slump test, the problem is more difficult to solve, because it is then necessary for the concrete mixing truck to return to the depot in order to add extra particulate concrete ingredients to correct the problem. If the extra particulate ingredients are not added within a relatively short time period after excessive liquid component has been added, then the mix will still not dry with the required strength.

In addition, if excess liquid component has been added, the customer cannot be charged an extra amount for return of the concrete mixing track to the central depot for adding additional particulate concrete ingredients to correct the problem. This, in turn, means that the concrete supply company is not producing concrete economically.

One method and apparatus for mixing concrete in a concrete mixing device to a specified slump is disclosed in U.S. Pat. No. 5,713,663 (the '663 patent), the disclosure of which is hereby incorporated herein by reference. This method and apparatus recognizes that the actual driving force to rotate a mixing barrel filled with particulate concrete ingredients and a liquid component is directly related to the volume of the liquid component added. In other words, the slump of the mix in the barrel at that time is related to the driving force required to rotate the mixing barrel. Thus, the method and apparatus monitors the torque loading on the driving means used to rotate the mixing barrel so that the mix may be optimized by adding a sufficient volume of liquid component in attempt to approach a predetermined minimum torque loading related to the amount of the particulate ingredients in the mixing barrel.

More specifically, sensors are used to determine the torque loading. The magnitude of the torque sensed may then be monitored and the results stored in a storage means. The store means can subsequently be accessed to retrieve information therefrom which can be used, in turn, to provide processing of information relating to the mix. In one case, it may be used to provide a report concerning the mixing.

Improvements related to sensing and determining slump are desirable.

Other methods and systems for remotely monitoring sensor data in delivery vehicles are disclosed in U.S. Pat. No. 6,484,079 (the '079 patent), the disclosure of which is also hereby incorporated herein by reference. These systems and methods remotely monitor and report sensor data associated with a delivery vehicle. More specifically, the data is collected and recorded at the delivery vehicle thus minimizing the bandwidth and transmission costs associated with transmitting data back to a dispatch center. The '079 patent enables the dispatch center to maintain a current record of the status of the delivery by monitoring the delivery data at the delivery vehicle to determine whether a transmission event has occurred. The transmission event provides a robust means enabling the dispatch center to define events that mark the delivery progress. When a transmission event occurs, the sensor data and certain event data associated with the transmission event may be transmitted to the dispatch center. This enables the dispatch center to monitor the progress and the status of the delivery without being overwhelmed by unnecessary information. The '079 patent also enables data concerning the delivery vehicle and the materials being transported to be automatically monitored and recorded such that an accurate record is maintained for all activity that occurs during transport and delivery.

The '079 patent remotely gathers sensor data from delivery vehicles at a dispatch center using a highly dedicated communications device mounted on the vehicle. Such a communications device is not compatible with status systems used in the concrete industry.

Improvements related to monitoring sensor data in delivery vehicles using industry standard status systems are desirable.

A further difficulty has arisen with the operation of concrete delivery vehicles in cold weather conditions. Typically a concrete delivery truck carries a water supply for maintaining the proper concrete slump during the delivery cycle. Unfortunately this water supply is susceptible to freezing in cold weather, and/or the water lines of the concrete truck are susceptible to freezing. The truck operator's duties should include monitoring the weather and ensuring that water supplies do not freeze; however, this is often not done and concrete trucks are damaged by frozen pipes, and/or are taken out of service to be thawed after freezing.

Accordingly, improvements are needed in cold weather management of concrete delivery vehicles.

SUMMARY OF THE INVENTION

Generally, the present invention provides a system for calculating and reporting slump in a delivery vehicle having a mixing drum and hydraulic drive for rotating the mixing drum. The system includes a rotational sensor mounted to the mixing drum and configured to sense a rotational speed of the mixing drum, a hydraulic sensor coupled to the hydraulic drive and configured to sense a hydraulic pressure required to turn the mixing drum, and a communications port configured to communicate a slump calculation to a status system commonly used in the concrete industry. The rotational speed of the mixing drum is used to qualify a calculation of current slump based on the hydraulic pressure required to turn the mixing drum. A processor may be electrically coupled to the rotational sensor and the hydraulic sensor and configured to qualify and calculate the current slump based on the hydraulic pressure required to turn the mixing drum.

In an embodiment of this aspect, the stability of the drum rotation speed is measured and used to qualify slump readings. Specifically, unstable drum speeds are detected and the resulting variable slump readings are ignored.

The delivery vehicle may further include a liquid component source, while the system further includes a flow meter and flow valve coupled to the liquid component source. The processor is also electrically coupled to the flow meter and the flow valve and is configured to control the amount of a liquid component added to the mixing barrel to reach a desired slump.

Embodiments of this aspect include detailed controls not only for managing the introduction of fluids but also tracking manual activity adding either water or superplasticizer to the mixture, as well as evaluating the appropriateness of drum activity, the adequacy of mixing, and the details of concrete pour actions. This provision for detailed logging and tracking is also an independent aspect of the invention.

It is also an independent aspect of the invention to provide novel configurations of a concrete truck water supply to facilitate cold weather operation, and to control the same to manage cold weather conditions. The invention also features novel configurations of sensors for drum rotation detection, and novel configurations for communication of status to a central dispatch center.

In a further aspect, the invention provides a method for managing and updating slump lookup tables and/or processor code while the vehicle is in service.

Various additional objectives, advantages, and features of the invention will become more readily apparent to those of ordinary skill in the art upon review of the following detailed description of embodiments taken in conjunction with the accompanying drawings.

DETAILED DESCRIPTION OF THE EMBODIMENTS OF THE INVENTION

Figure 1:
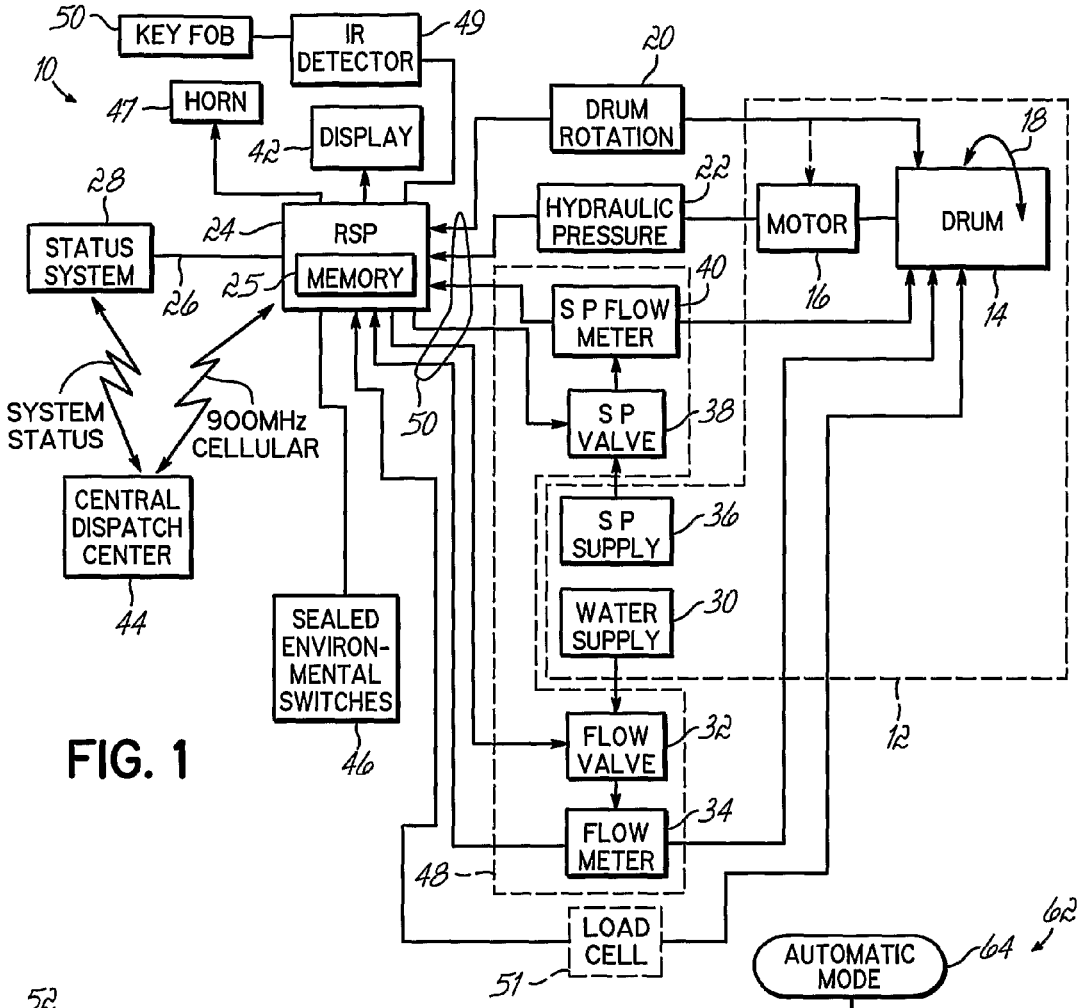
FIG. 1 is block diagram of a system for calculating and reporting slump in a delivery vehicle constructed in accordance with an embodiment of the invention.

Referring to FIG. 1, a block diagram of a system 10 for calculating and reporting slump in a delivery vehicle 12 is illustrated. Delivery vehicle 12 includes a mixing drum 14 for mixing concrete having a slump and a motor or hydraulic drive 16 for rotating the mixing drum 14 in the charging and discharging directions, as indicated by double arrow 18. System 10 comprises a rotational sensor 20, which may be installed directly on or mounted to the mixing drum 14, or included in the motor driving the drum, and configured to sense the rotational speed and direction of the mixing drum 14. The rotational sensor may include a series of magnets mounted on the drum and positioned to interact with a magnetic sensor on the truck to create a pulse each time the magnet passes the magnetic sensor. Alternatively, the rotational sensor may be incorporated in the driving motor 16, as is the case in concrete trucks using Eaton 2000, 4000 and 6000 series hydraulic motors. In a third potential embodiment, the rotational sensor may be an integrated accelerometer mounted on the drum of the concrete truck, coupled to a wireless transmitter. In such an embodiment a wireless receiver mounted to the truck could capture the transmitted signal from the accelerometer and determine therefrom the rotational state of the drum. System 10 further includes a hydraulic sensor coupled to the motor or hydraulic drive 16 and configured to sense a hydraulic pressure required to turn the mixing drum 14.

System 10 further comprises a processor or ready slump processor (RSP) 24 including a memory 25 electrically coupled to the hydraulic sensor 22 and the rotational sensor 20 and configured to qualify and calculate the current slump of the concrete in the mixing drum 14 based the rotational speed of the mixing drum and the hydraulic pressure required to turn the mixing drum, respectively. The rotational sensor and hydraulic sensor may be directed connected to the RSP 24 or may be coupled to an auxiliary processor that stores rotation and hydraulic pressure information for synchronous delivery to the RSP 24. The RSP 24, using memory 25, may also utilize the history of the rotational speed of the mixing drum 14 to qualify a calculation of current slump.

A communications port 26, such as one in compliance with the RS 485 modbus serial communication standard, is configured to communicate the slump calculation to a status system 28 commonly used in the concrete industry, such as, for example, TracerNET (now a product of Trimble Navigation Limited, Sunnyvale, Calif.), which, in turn, wireless communicates with a central dispatch center 44. An example of a wireless status system is described by U.S. Pat. No. 6,611,755, which is hereby incorporated herein in its entirety. It will be appreciated that status system 28 may be any one of a variety of commercially available status monitoring systems. Alternatively, or in addition, the status system 28 may utilize a separate communication path on a licensed wireless frequency, e.g. a 900 MHz frequency, for communications between RSP 24 and the central dispatch office when concrete trucks are within range of the central office, permitting more extensive communication for logging, updates and the like when the truck is near to the central office, as described below. RSP 24 may also be connected directly to the central office dispatcher, via a 900 MHz local wireless connection, or via a cellular wireless connection. RSP 24 may over this connection directly deliver and receive programming and status information to and from the central dispatch center without the use of a status system.

Delivery vehicle 12 further includes a water supply 30 while system 10 further comprises a flow valve 32 coupled to the water supply 30 and configured to control the amount of water added to the mixing drum 14 and a flow meter 34 coupled to the flow valve 32 and configured to sense the amount of water added to the mixing drum 14. The water supply is typically pressurized by a pressurized air supply generated by the delivery truck's engine. RSP 24 is electrically coupled to the flow valve 32 and the flow meter 34 so that the RSP 24 may control the amount of water added to the mixing drum 14 to reach a desired slump. RSP 24 may also obtain data on water manually added to the drum 14 by a hose connected to the water supply, via a separate flow sensor or from status system 28.

Similarly, and as an alternative or an option, delivery vehicle 12 may further include a superplasticizer (SP) supply 36 and system 10 may further comprise a SP flow valve 38 coupled to the SP supply 36 and configured to control the amount of SP added to the mixing drum 14, and a SP flow meter 40 coupled to the SP flow valve 38 and configured to sense the amount of SP added to the mixing drum 14. In one embodiment, RSP 24 is electrically coupled to the SP flow valve 38 and the SP flow meter 40 so that the RSP 24 may control the amount of SP added to the mixing drum 14 to reach a desired slump. Alternatively, SP may be manually added by the operator and RSP 24 may monitor the addition of SP and the amount added.

System 10 may also further comprise an optional external display, such as display 42. Display 42 actively displays RSP 24 data, such as slump values, and may be used by the status system 28 for wireless communication from central dispatch center 44 to the delivery site.

A set of environmentally sealed switches 46 may be provided by the RSP 24 to permit manual override, which allows the delivery vehicle 12 to be operated manually, i.e., without the benefit of system 10, by setting an override switch and using other switches to manually control water, superplasticizer, and the like. A keypad on the status system would typically be used to enter data into the RSP 24 or to acknowledge messages or alerts, but switches 46 may be configured as a keypad to provide such functions directly without the use of a status system.

A horn 47 is included for the purpose of alerting the operator of such alert conditions.

Operator control of the system may also be provided by an infrared or RF key fob remote control 50, interacting with an infrared or RF signal detector 49 in communication with RSP 24. By this mechanism, the operator may deliver commands conveniently and wirelessly.

In one embodiment of the present invention, all flow sensors and flow control devices, e.g., flow valve 32, flow meter 34, SP flow valve 38, and SP flow meter 40, are contained in an easy-to-mount manifold 48 while the external sensors, e.g., rotational sensor 20 and hydraulic pressure sensor 22, are provided with complete mounting kits including all cables, hardware and instructions. In another embodiment, illustrated in FIG. 6, the water valve and flow meter may be placed differently, and an additional valve for manual water may be included, to facilitate cold weather operation. Varying lengths of interconnects 50 may be used between the manifold 48, the external sensors 20, 22, and the RSP 24. Thus, the present invention provides a modular system 10.

In operation, the RSP 24 manages all data inputs, e.g., drum rotation, hydraulic pressure, and water and SP flow, to calculate current slump and determine when and how much water and/or SP should be added to the concrete in mixing drum 14, or in other words, to a load. (As noted, rotation and pressure may be monitored by an auxiliary processor under control of RSP 24.) The RSP 24 also controls the water flow valve 32, an optional SP flow valve 38, and an air pressure valve (not shown). (Flow and water control may also be managed by another auxiliary processor under control of the RSP 24.) The RSP 24 typically uses ticket information and discharge drum rotations and motor pressure to measure the amount of concrete in the drum, but may also optionally receive data from a load cell 51 coupled to the drum for a weight-based measurement of concrete volume. The RSP 24 also automatically records the slump at the time the concrete is poured, to document the delivered product quality.

The RSP 24 has three operational modes: automatic, manual and override. In the automatic mode, the RSP 24 adds water to adjust slump automatically, and may also add SP in one embodiment. In the manual mode, the RSP 24 automatically calculates slump, but an operator is required to instruct the RSP 24 to make any additions, if necessary. In the override mode, all control paths to the RSP 24 are disconnected, giving the operator complete responsibility for any changes and/or additions. All overrides are documented by time and location.

Figure 2:
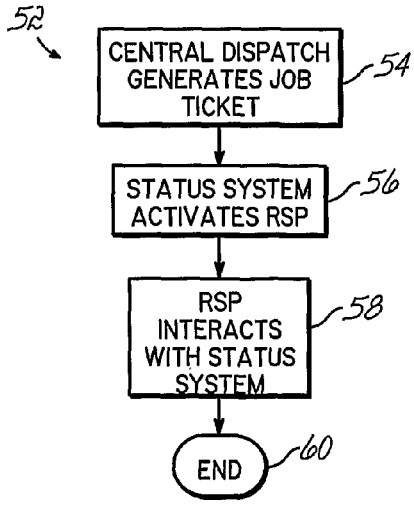
FIG. 2 is a flow charge generally illustrating the interaction of the ready slump processor and status system of FIG. 1.

Referring to FIG. 2, a simplified flow chart 52 describing the interaction between the central dispatch center 44, the status system 28, and the RSP 24 in FIG. 1 is shown. More specifically, flow chart 52 describes a process for coordinating the delivery of a load of concrete at a specific slump. The process begins in block 54 wherein the central dispatch center 44 transmits specific job ticket information via its status system 28 to the delivery vehicle's 12 on-board ready slump processor. The job ticket information may include, for example, the job location, amount of material or concrete, and the customer-specific or desired slump.

Next, in block 56, the status system 28 on-board computer activates the RSP 24 providing job ticket information, e.g., amount of material or concrete, and the customer-specific or desired slump. Other ticket information and vehicle information could also be received, such as job location as well as delivery vehicle 12 location and speed.

In block 58, the RSP 24 continuously interacts with the status system 28 to report accurate, reliable product quality data back to the central dispatch center 44. Product quality data may include the exact slump level reading at the time of delivery, levels of water and/or SP added to the concrete during the delivery process, and the amount, location and time of concrete delivered. The process 52 ends in block 60.

Further details of the management of the RSP 24 of slump and its collection of detailed status information is provided below with reference to FIG. 4 et seq.

Figure 3:
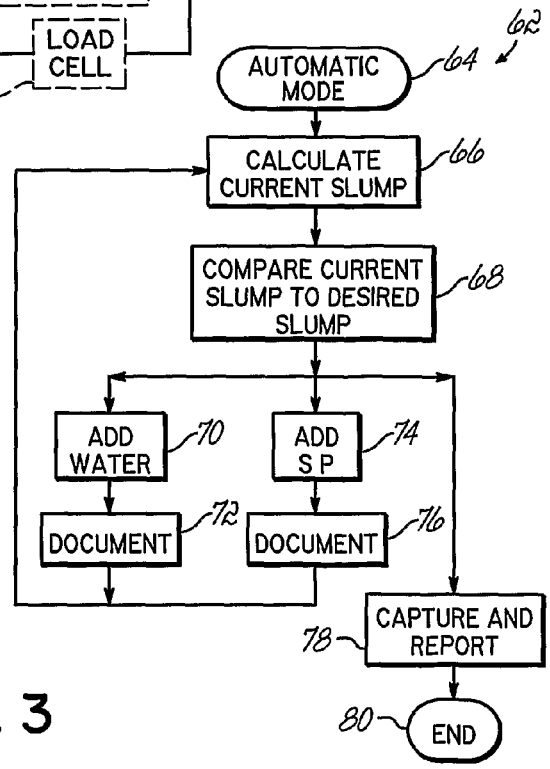
FIG. 3 is a flow chart showing an automatic mode for the RSP in FIG. 1.

Referring to FIG. 3, a flow chart 62 describing an automatic mode 64 for load management by the RSP 24 in FIG. 1 is shown. In this embodiment, in an automatic mode 64, the RSP 24 automatically incorporates specific job ticket information from the central dispatch center 44, delivery vehicle 12 location and speed information from the status system 28, and product information from delivery vehicle 12 mounted sensors, e.g., rotational sensor 20 and hydraulic pressure sensor 22. The RSP 24 then calculates current slump as indicated in block 66.

Next, in block 68, the current slump is compared to the customer-specified or desired slump. If the current slump is not equal to the customer-specified slump, a liquid component, e.g., water, is automatically added to arrive at the customer-specified slump. Furthermore, superplasticizer may be automatically added to meet customer requirements as specified in a ticket or entered by the operator. (SP typically makes concrete easier to work, and also affects the relationship between slump and drum motor pressure, but has a limited life. Thus, in the detailed embodiment noted below the addition of SP is manually controlled, although the job ticket and status information may permit automatic addition of SP in some embodiments.) As seen at block 70, water is added, while as seen at block 74, a SP is added. Once water or a SP is added, the amount of water or SP added is documented, as indicated in blocks 72 and 76, respectively. Control is then looped back to block 66 wherein the current slump is again calculated.

Once the current slump is substantially equal to the customer-specified or desired slump in block 68, the load may be delivered and control is passed to block 78. In block 78, the slump level of the poured product is captured and reported, as well as the time, location and amount of product delivered. Automatic mode 64 ends in block 80.

Figure 4:
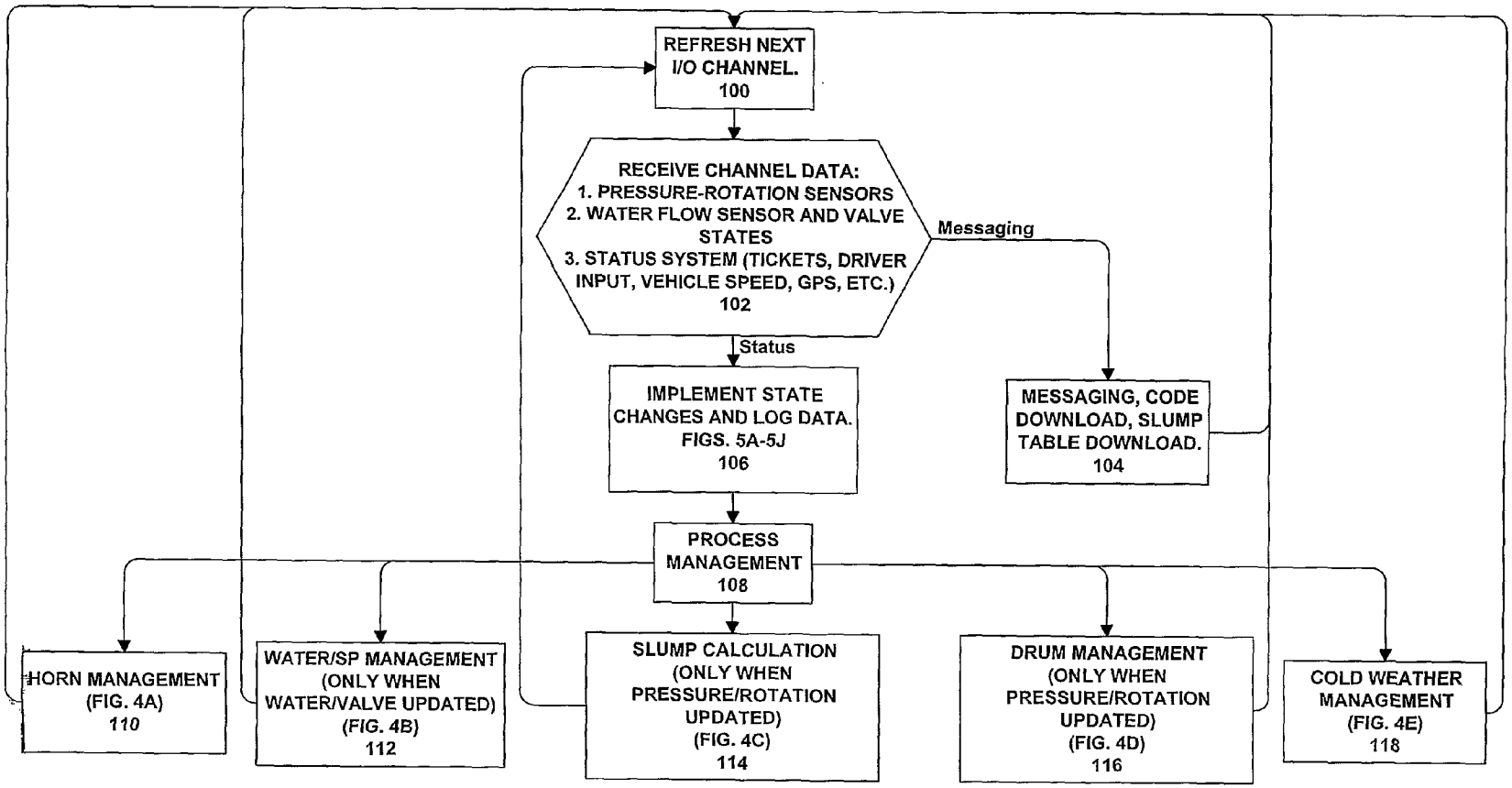
FIG. 4 is a flow chart of the detailed operation of the ready slump processor of FIG. 1.

Referring now to FIG. 4, a substantially more detailed embodiment of the present invention can be described. In this embodiment automatic handling of water and monitoring of water and superplasticizer input is combined with tracking the process of delivery of concrete from a mixing plant to delivery truck to a job site and then through pouring at the job site.

FIG. 4 illustrates the top-level process for obtaining input and output information and responding to that information as part of process management and tracking. Information used by the system is received through a number of sensors, as illustrated in FIG. 1, through various input/output channels of the ready slump processor. In a first step 100, information received on one of those channels is refreshed. Next in step 102, the channel data is received. Channel data may be pressure and rotation sensor information, water flow sensor information and valve states, or communications to or requests for information from the vehicle status system 28, such as relating to tickets, driver inputs and feedback, manual controls, vehicle speed information, status system state information, GPS information, and other potential communications. Communications with the status system may include messaging communications requesting statistics for display on the status system or for delivery to the central dispatch center, or may include new software downloads or new slump lookup table downloads.

For messaging communications, code or slump table downloads, in step 104 the ready slump processor completes the appropriate processing, and then returns to step 100 to refresh the next channel. For other types of information, processing of the ready slump processor proceeds to step 106 where changes are implemented and data is logged, in accordance with the current state of the ready slump processor. Further information on states of the ready slump processor and state changes appears below in connection with FIG. 5 and FIGS. 5A-5J.

In addition to processing state changes, process management 108 by the ready slump processor involves other activities shown on FIG. 4. Specifically, process management may include management of the horn in step 110, management of water and super plasticizer monitoring in step 112, management of slump calculations in step 114, and management of drum rotation tracking in step 116, and management of cold weather activity in step 118.

As noted in FIG. 4, water management and superplasticizer monitoring is only performed when water or valve sensor information is updated, and slump calculations are only performed when pressure and rotation information is updated, and drum management in step 116 is only performed when pressure and rotation information is updated.

Figure 4A:
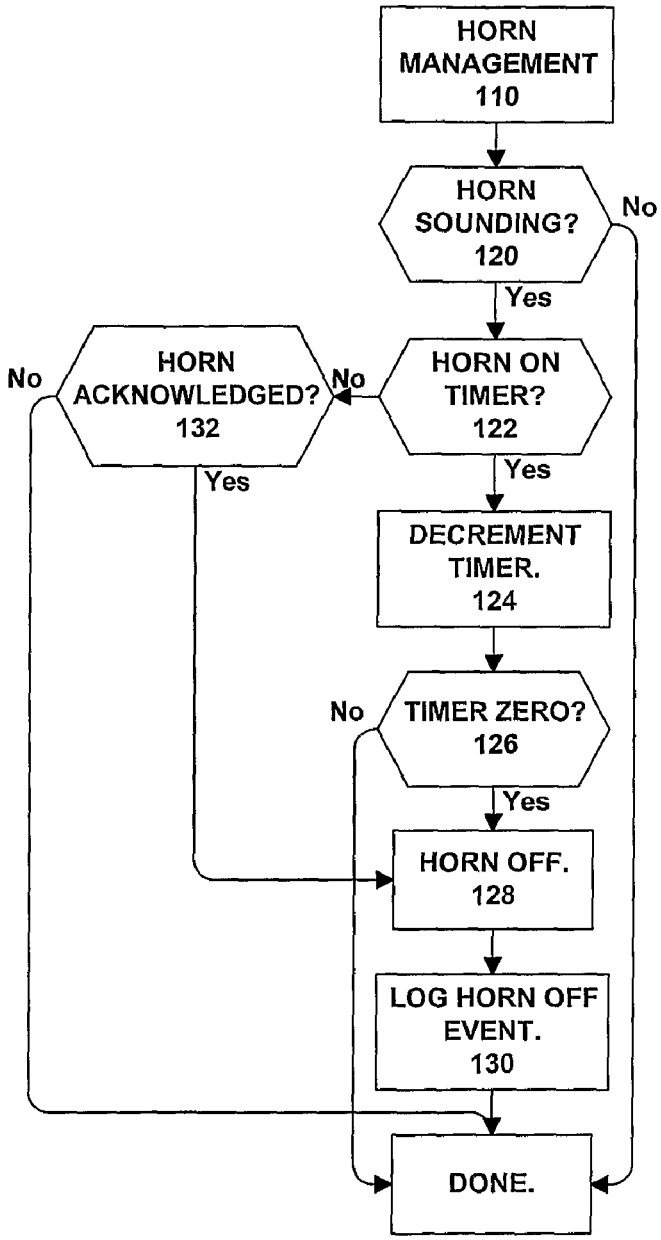
FIG. 4A is a flow chart of the management of the horn operation by the ready slump processor.

Referring now to FIG. 4A, horn management in step 110 can be explained. The horn of the ready slump processor is used to alert the operator of alarm conditions, and may be activated continuously until acknowledged, or for a programmed time period. If the horn of the ready slump processor is sounding in step 120, then it is determined in step 122 whether the horn is sounding for a specified time in response to a timer. Is so, then in step 124 the timer is decremented, and in step 126 it is determined whether the timer has reached zero. If the timer has reached zero, in step 128 the horn is turned off, and in step 130 the event of disabling the horn is logged. In step 122 if the horn is not responsive to a timer, then the ready slump processor determines in step 132 whether the horn has been acknowledged by the operator, typically through a command received from the status system. If the horn has been acknowledged in step 132, then processing continues to step 128 and the horn is turned off.

Figure 4B:
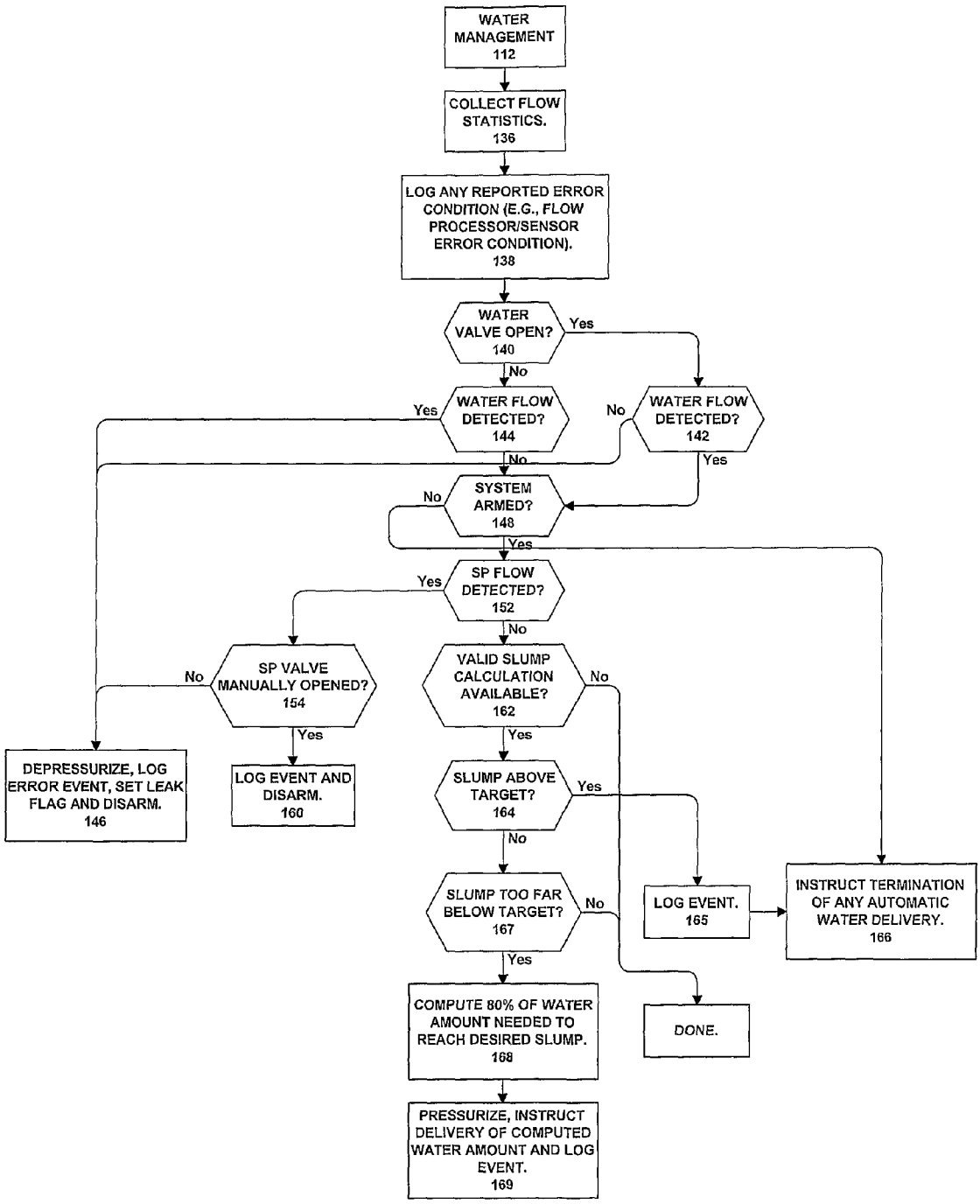
FIG. 4B is a flow chart of the management of the water delivery system by the ready slump processor.

Referring now to FIG. 4B, water management in step 112 can be explained. The water management process involves continuous collection of the flow statistics for both water and super plasticizer, and, in step 136, collection of statistics on detected flows. In addition, error conditions reported by sensors or a processor responsible for controlling water or super plasticizer flow are logged in step 138.

The water management routine also monitors for water leaks by passing through steps 140, 142 and 144. In step 140 it is determined whether the water valve is currently open, e.g., due to the water management processor adding water in response to a prior request for water, or a manual request for water by the operator (e.g., manually adding water to the load or cleaning the drum or truck after delivery). If the valve is open, then in step 142 it is determined whether water flow is being detected by the flow sensor. If the water valve is open and there is no detected water flow, then an error is occurring and processing continues to step 146 at which time the water tank is depressurized, an error event is logged, and a "leak" flag is set to prevent any future automatic pressurization of the water tank. If water flow is detected in step 150, then processing continues to step 148.

Returning to step 140, if the water valve is not open, then in step 144 is determined whether water flow is nevertheless occurring. If so, then an error has occurred and processing again proceeds to step 146, the system is disarmed, the water delivery system is depressurized, a leak flag is set and an error event is logged.

If water flow is not detected in step 156, then processing continues to step 148. Processing continues past step 148 only if the system is armed. The water management system must be armed in accordance with various conditions discussed below, for water to be automatically added by the ready slump processor. If the system is not armed in step 148, then in step 166, any previously requested water addition is terminated.

If the system is armed, then processing continues to step 152 in which the system determines if the user has requested super plasticizer flow. If super plasticizer flow is detected, after step 152, in step 154 it is verified that the super plasticizer valve is currently open. If the valve is open, this indicates that normal operation is proceeding, but that the operator has decided to manually add super plasticizer. In this situation, in the illustrated embodiment, processing continues to step 160 and the system is disarmed, so that no further water will be automatically added. This is done because superplasticizer affects the relationship of pressure and slump. If the super plasticizer valve is not open in step 154, then in error has occurred, because super plasticizer flow is detected without the valve having been opened. In this situation, at step 146 the air system is depressurized and an error event is logged, and the system is disarmed.

If the above tests are passed, then processing arrives at step 162, and it is determined whether a valid slump calculation is available. In the absence of a valid slump calculation, no further processing is performed. If the current slump calculation is valid, then it is determined whether the current slump is above the target value in step 164. If the current slump is above the target value, then in step 165 and event is logged and in step 166 an instruction is delivered to terminate any currently ongoing automatic water delivery. If the current slump is not above target, water may need to be added. In step 167, it is determined whether the slump is too far below the target value. If so, processing continues from step 167 to step 168, in which a specified percentage, e.g. 80%, of the water needed to reach the desired slump is computed, utilizing in the slump tables and computations discussed above. (The 80% parameter, and many others used by the ready slump processor, are adjustable via a parameter table stored by the ready slump processor, which is reviewed in detail below.) Then, in step 169, the water tank is pressurized and an instruction is generated requesting delivery of the computed water amount, and the event is logged.

Figure 4C:
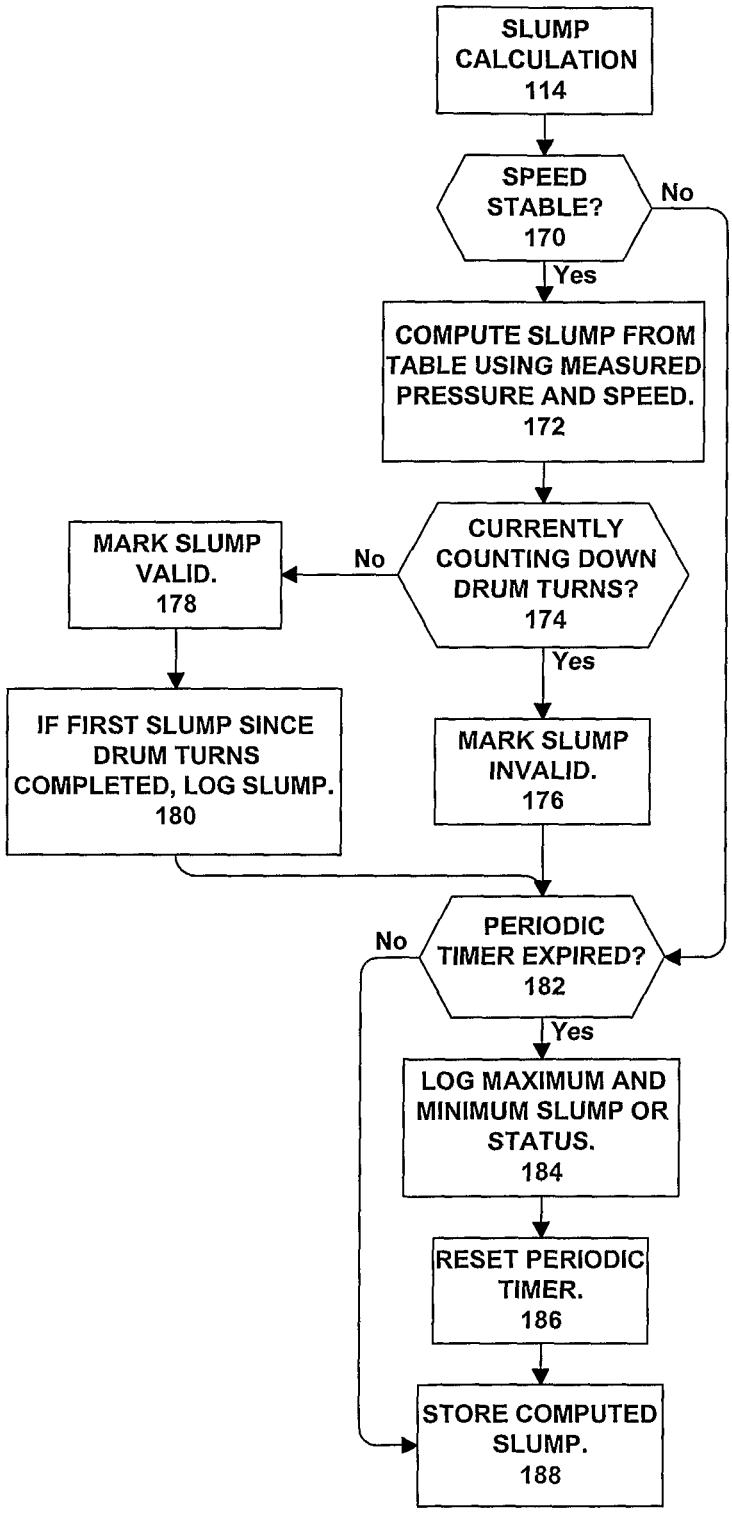
FIG. 4C is a flow chart of the management of slump calculations by the ready slump processor.

Referring now to FIG. 4C, slump calculation management in step 114 can be explained. Some calculations will only proceed if the drum speed is stable. The drum speed may be unstable if the operator has increased the drum speed for mixing purposes, or if changes in the vehicle speed or transmission shifting has occurred recently. The drum speed must be stable and below a threshold maximum RPM for valid slump calculation to be generated. In step 170, therefore, the drum speed stability is evaluated, by analyzing stored drum rotation information collected as described below with reference to FIG. 4D. If the drum speed is stable, then in step 172 a slump calculation is made. Slump calculations in step 172 are performed utilizing an empirically generated lookup table identifying concrete slump as a function of measured hydraulic pressure of the drum drive motor and drum rotational speed. After computing a slump value in step 172, in step 174 it is determined whether a mixing process is currently underway. In a mixing process, as discussed below, the drum must be turned a threshold number of times before the concrete in the drum will be considered fully mixed. If, in step 174, the ready slump processor is currently counting down the number of drum turns, then processing proceeds to step 176 and the computed slump value is marked invalid, because the concrete is not yet considered fully mixed. If there is no current mixing operation in step 174, processing continues from step 174 to step 178 and the current slump measurement is marked valid, and then to step 180 where it is determined whether the current slump reading is the first slump reading generated since a mixing operation was completed. If so, then the current slump reading is logged so that the log will reflect the first slump reading following mixing.

Following step 176 or step 180, or following step 170 if the drum speed is not stable, in step 182 a periodic timer is evaluated. This periodic timer is used to periodically log slump readings, whether or not these slump ratings are valid. The period of the timer may be for example one minute or four minutes. When the periodic timer expires, processing continues from step 182 to step 184, and the maximum and minimum slump values read during the previous period are logged, and/or the status of the slump calculations is logged. Thereafter in step 186 the periodic timer is reset. Whether or not slump readings are logged in step 184, in step 188 any computed slump measurement is stored within the ready slump processor for later use by other processing steps.

Figure 4D:
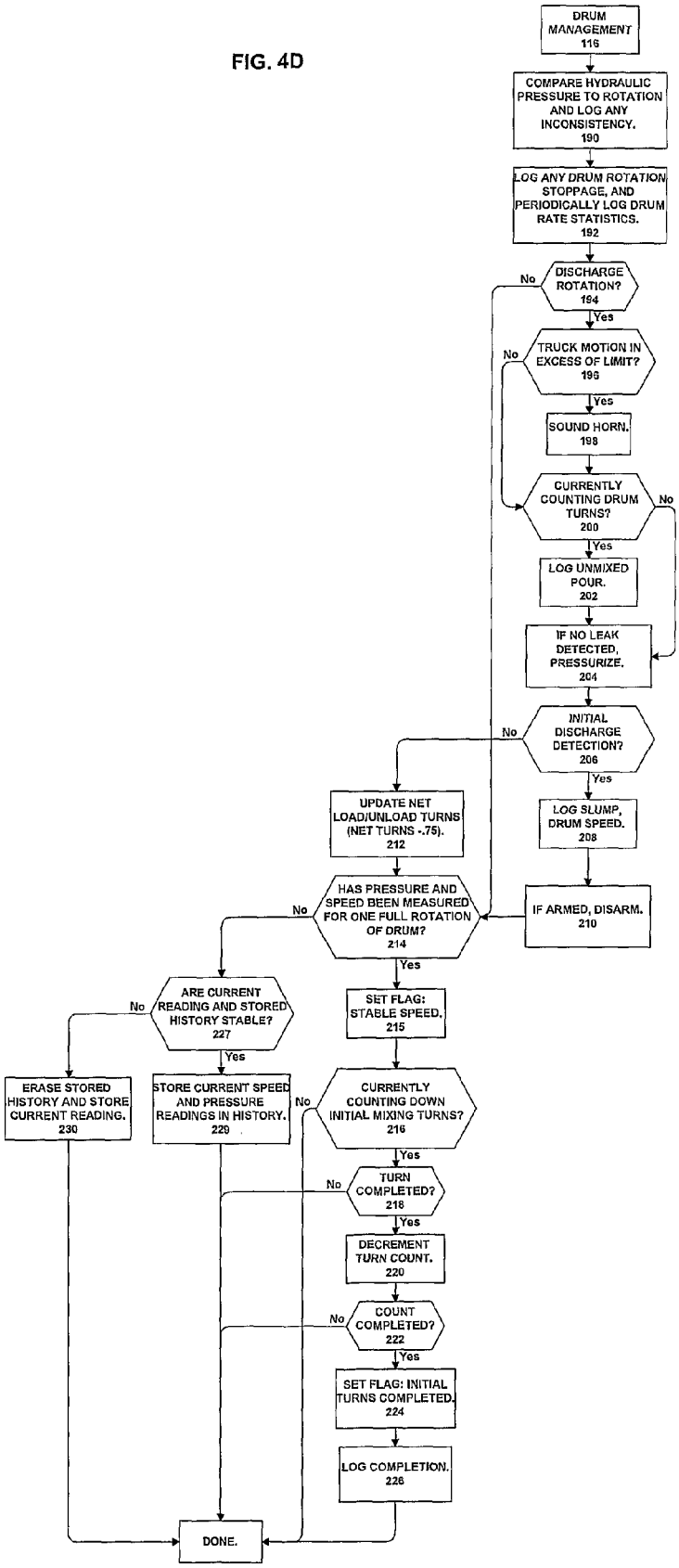
FIG. 4D is a flow chart of the drum management performed by the ready slump processor.

Referring now to FIG. 4D, drum management of step 116 can be explained. Drum management includes a step 190, in which the most recently measured hydraulic pressure of the drum motor is compared to the current rotation rate, and any inconsistency between the two is logged. This step causes the ready slump processor to capture sensor errors or motor errors. In step 192 a log entry is made in the event of any drum rotation stoppage, so that the log will reflect each time the drum rotation terminates, which documents adequate or inadequate mixing of concrete.

In step 194 of the drum management process, rotation of the drum in discharge direction is detected. If there is discharge rotation, then in step 196, the current truck speed is evaluated. If the truck is moving at a speed in excess of a limit (typically the truck would not move faster than one or two mph during a pour operation), then the discharge is likely unintended, and in step 198 the horn is sounded indicating that a discharge operation is being performed inappropriately.

Assuming the truck is not moving during the discharge, then a second test is performed in step 200, to determine whether concrete mixing is currently underway, i.e., whether the ready slump processor is currently counting drum turns. If so, then in step 202, a log entry is generated indicating an unmixed pour—indicating that the concrete being poured appears to have been in incompletely mixed.

In any case where discharge rotation is detected, in step 204 the air pressure for the water system is pressurized (assuming a leak has not been previously flagged) so that water may be used for cleaning of the concrete truck.

After step 204, it is determined whether the current discharge rotation event is the first discharge detected in the current delivery process. If, in step 206, the current discharge is the first discharge detected, then in step 208 the current slump calculations to current drum speed are logged. Also, in step 210, the water delivery system is disarmed so that water management will be discontinued, as discussed above with reference to FIG. 4B. If the current discharge is not the first discharge, then in step 212 the net load and unload turns computed by the ready slump processor is updated.

In the typical initial condition of a pour, the drum has been mixing concrete by rotating in the charging direction for a substantial number of turns. In this condition, three-quarters of a turn of discharge rotation are required to begin discharging concrete. Thus, when discharge rotation begins from this initial condition, the ready slump processor subtracts three-quarters of a turn from the detected number of discharge turns, to compute the amount of concrete discharged.

It will be appreciated that, after an initial discharge, the operator may discontinue discharge temporarily, e.g., to move from one pour location to another at the job site. In such an event, typically the drum will be reversed, and again rotate in the charge direction. In such a situation, the ready slump processor tracks the amount of rotation in the charge direction after an initial discharge. When the drum again begins rotating in the discharge direction for a subsequent discharge, then the amount of immediately prior rotation in the charge direction (maximum three-quarters of a turn) is subtracted from the number of turns of discharge rotation, to compute the amount of concrete discharged. In this way, the ready slump processor arrives at an accurate calculation of the amount of concrete discharged by the drum. The net turns operation noted in step 212 will occur each time the discharge rotation is detected, so that a total of the amount of concrete discharge can be generated that is reflective of each discharge rotation performed by the drum.

After the steps noted above, drum management proceeds to step 214, in which the drum speed stability is evaluated. In step 214, it is determined whether the pressure and speed of the drum hydraulic motor have been measured for a full drum rotation. If so, then in step 215 a flag is set indicating that the current rotation speed is stable. Following this step, in step 216 it is determined whether initial mixing turns are being counted by the ready slump processor. If so, then in step 218 it is determined whether a turn has been completed. If a turn has been completed then in step 220 the turn count is decremented and in step 222 it is determined whether the current turn count has reached the number needed for initial mixing. If initial mixing has been completed then in step 224 a flag is set to indicate that the initial turns been completed, and in step 226 completion of mixing is logged.

If in step 214 pressure and speed have not been measured for a full rotation of the drum, then in step 227 the current pressure and speed measurements are compared to stored pressure and speed measurements for the current drum rotation, to determine if pressure and speed are stable. If the pressure and speed are stable, then the current speed and pressure readings are stored in the history (step 229) such that pressure and speed readings will continue to accumulate until a full drum rotation has been completed. If, however, the current drum pressure and speed measurements are not stable as compared to prior measurements for the same drum rotation, then the drum rotation speed or pressure are not stable, and in step 230 the stored pressure and speed measurements are erased, and the current reading is stored, so that the current reading may be compared to future readings to attempt to accumulate a new full drum rotation of pressure and speed measurements that are stable and usable for a slump measurement. It has been found that accurate slump measurement is not only dependent upon rotation speed as well as pressure, but that stable drum speed is needed for slump measurement accuracy. Thus, the steps in FIG. 4D maintain accuracy of measurement.

Figure 4E:
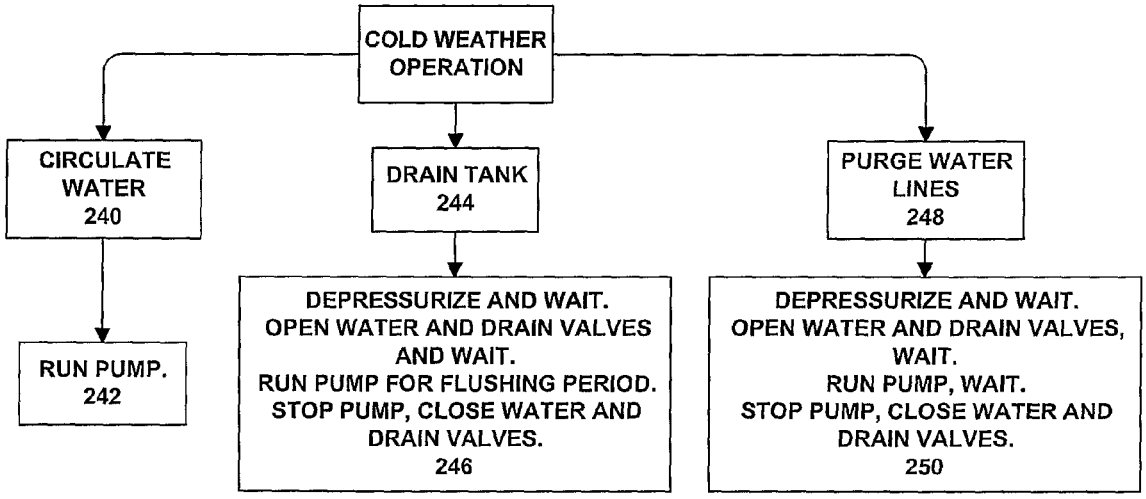
FIG. 4E is a flow chart of the cold weather functions of the ready slump processor.
Figure 6:
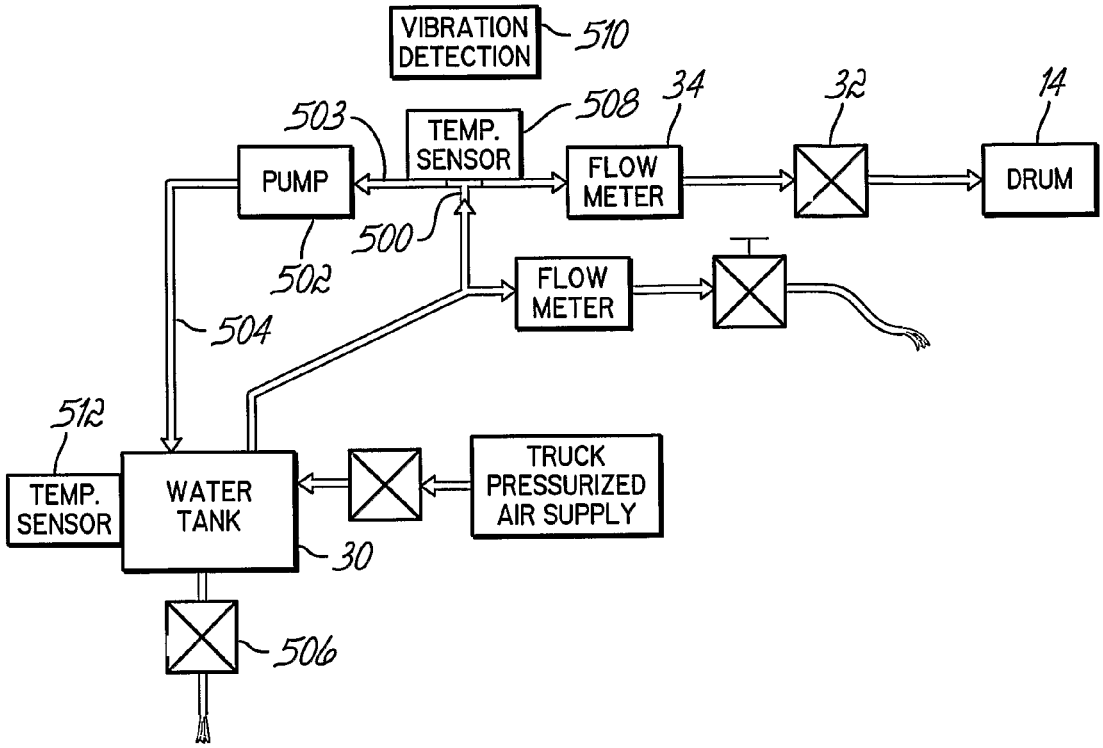
FIG. 6 is a diagram of a water delivery system configured for cold weather operation in accordance with an embodiment of the invention.

Referring now to FIGS. 4E and 6, the cold weather functions of the ready slump processor can be explained. As seen in FIG. 6, the concrete truck is retrofitted with a T fitting 500 between the water tank and the drum, and a pump 502 and fluid path 503/504 is provided to allow water to be returned to the water supply tank 30 under specified conditions. Pump 502 and T fitting 500 are mounted higher than water tank 30 so that water will flow out of the T fitting and connected fluid paths when the tank is to be purged. Furthermore, the tank is fitted with a controllable purge valve 506 to permit purging thereof. A temperature sensor 508 is mounted to the T fitting to detect the temperature of the fitting, and a vibration sensor 510 is further mounted to a suitable point in the truck to detect whether the truck motor is running from the existence of vibration. A second temperature sensor 512 is mounted to the tank to sense tank temperature. A temperature sensor may also be mounted to detect ambient air temperature.

Referring now to FIG. 4E, the ready slump processor, or an auxiliary processor dedicated to cold weather control, may perform a number of operations using the components of FIG. 6. Most basically, as shown at step 240, water may be circulated in the fluid lines of the water delivery system by running the pump at step 242. This may be done, e.g., when the temperature sensor indicates that the temperature of the T-fitting has been at a freezing temperature for longer than a threshold time. In cold weather the water tank is typically loaded with previously heated water, and thus serves as a source of heat that can be used to maintain water lines open during normal operation of the truck. It is further possible to include a radiator in or adjacent to the tank coupled to the engine so that the water tank is actively heated.

In addition to circulating water, the arrangement of FIG. 6 may be controlled to drain the tank automatically to prevent freezing, as shown at step 244. This may be done, for example, at completion of a job or whenever temperature and time variables indicate that the tank is in danger of freezing. To drain the tank, in step 246, the tank is depressurized (by terminating air pressure and waiting a depressurization time) and then the water valve 32 and drain valve 506 are opened, causing water to flow out drain valve 506 to be replaced by air drawn through the water valve 32. After a period of draining in this manner, the pump 502 is activated to circulate air into lines 503 and 504. Finally, after sufficient time to drain the water tank, water valve 32 and drain valve 506 are closed and pump 502 is shut off.

The arrangement of FIG. 6 may also be controlled to purge the water lines, without draining the tank, as seen at step 248. This may be done, for example, each time there has been a water flow but water flow has ended, and the T fitting temperature is detected to be below freezing for a threshold time. For a purge operation, in step 350, the tank is depressurized, and the water valve 32 and drain valve 506 are opened momentarily, and then the pump 502 is run momentarily, to draw air into all of the fluid lines. The pump is then stopped, and the water and drain valves are closed.

Figure 5:
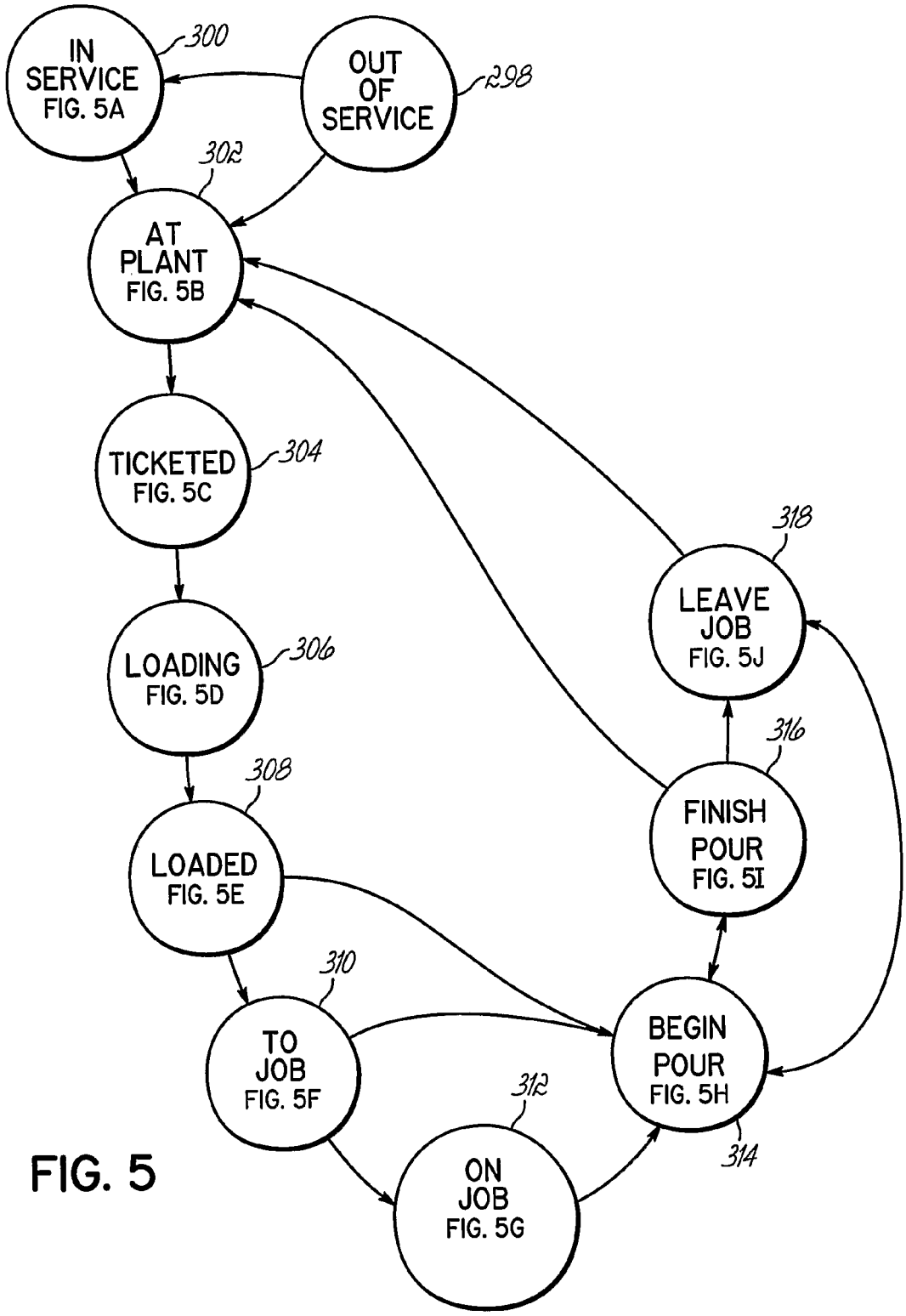
FIG. 5 is a state diagram showing the states of the status system and ready slump processor.

Referring now to FIG. 5, the states of the ready slump processor are illustrated. These states include an out_of_service state 298, in_service state 300, at_plant state 302, ticketed state 304, loading state 306, loaded state 308, to_job state 310, on_job state 312, begin_pour state 314, finish_pour state 316, and leave_job state 318. The out of service state is a temporary state of the status system that will exist when it is first initiated, and the status system will transition from that state to the in_service state or at_plant state based upon conditions set by the status system. The in_service state is a similar initial state of operation, indicating that the truck is currently in service and available for a concrete delivery cycle. The at_plant state 302 is a state indicating that the truck is at the plant, but has not yet been loaded for concrete or given a delivery ticket. The ticketed state 304 indicates that the concrete truck has been given a delivery ticket (order), but has not yet been loaded. A loading state 306 indicates that the truck is currently loading with concrete. The loaded state 308 indicates that the truck has been loaded with concrete. The to_job state 310 indicates that the truck is on route to its delivery site. The on_job state 312 indicates the concrete truck is at the delivery site. The begin_pour state 314 indicates that the concrete truck has begun pouring concrete at the job site.

It will be noted that a transition may be made from the loaded state or the to_job state directly to the begin_pour state, in the event that the status system does not properly identify the departure of the truck from the plant and the arrival of the truck at the job site (such as if the job site is very close to the plant). The finish_pour state 316 indicates that the concrete truck has finished pouring concrete at the job site. The leave_job state 318 indicates the concrete truck has left the job site after a pour.

It will be noted that transition may occur from the begin_pour state directly to the leave_job state in the circumstance that the concrete truck leaves the job site before completely emptying its concrete load. It will also be noted that the ready slump processor can return to the begin_pour state from the finish_pour state or the leave_job state in the event that the concrete truck returns to the job site or recommences pouring concrete at the job site. Finally, it will be noted that a transition may occur from either the finish_pour state or the leave_job state to the at_plant state in the event that the concrete truck returns to the plant. The concrete truck may not empty its entire load of concrete before returning to the plant, and this circumstance is allowed by the ready slump processor. Furthermore, as will be discussed in more detail below, the truck may discharge a partial portion of its load while at the plant without transitioning to the begin pour state, which may occur if a slump test is being performed or if a partial portion of the concrete in the truck is being discharged in order to add additional concrete to correct the slump of the concrete in the drum.

Figure 5A:
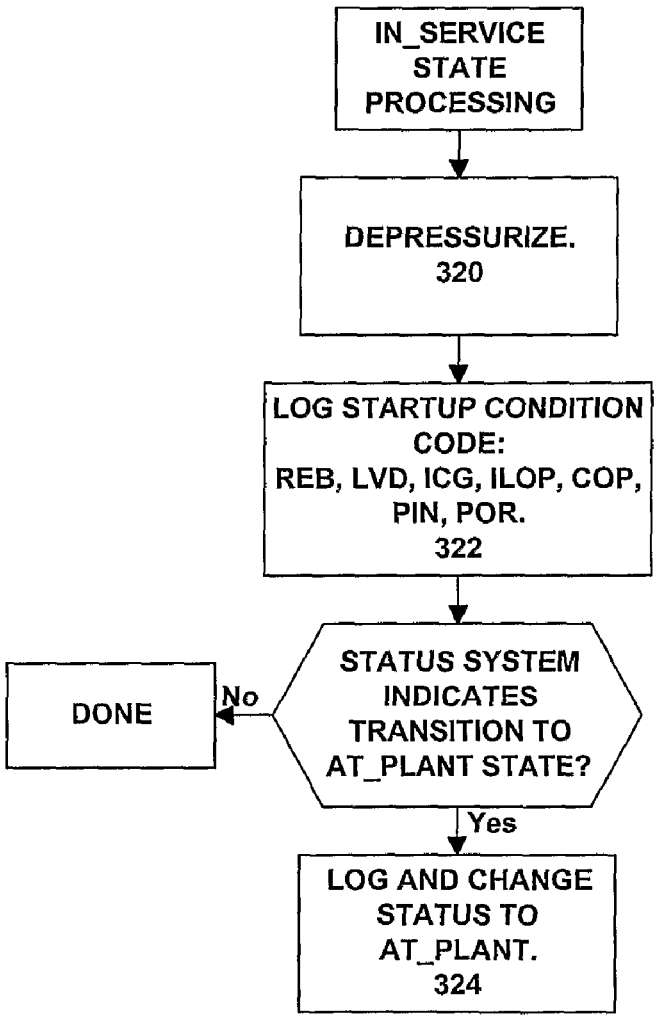
FIGS. 5A, 5B, 5C, 5D, 5E, 5F, 5G, 5H, 5I and 5J are flow charts of the actions taken by the ready slump processor in the in_service, at_plant, ticketed, loading, loaded, to_job, on_job, begin_pour, finish_pour and leave_job states, respectively.

Referring now to FIG. 5A, processing of the in service state can be explained. In the in service state, automatic water delivery is not utilized, and there should not be need for manual use of water by the truck operator, therefore the water and super plasticizer tanks are depressurized in step 320. Furthermore, as the service state occurs initially upon power up of the ready slump processor, a start up condition code is logged in step 322 to indicate the reason for the restart of the ready slump processor. These condition codes include REB for reboot, which indicates that the application has been restarted, typically due to a software update received by the system. The code LVD or low voltage detection, indicates that the power supply for the ready slump processor fell below a reliable operation limit, causing reboot of the ready slump processor. A condition code of ICG or internal clock generate, indicates that a problem occurred with the clock oscillator of the ready slump processor causing a reboot. The startup code of ILOP or illegal operation, indicates that a software error or an electrostatic discharge condition caused a reboot of the ready slump processor. The start code COP or computer operating properly, indicates that a software error or an electrostatic discharge caused reboot of the ready slump processor without that error being caught or handled by the ready slump processor. The code PIN indicates a hardware reset of the ready slump processor. The POR or power on reset code indicates that the ready slump processor has just been powered on, and that is the reason for reboot of the ready slump processor.

As noted above, the processor will transition from the in service state to the at plant state at the behest of the status system. Until this transition is requested, no state changes will occur. However, when the status system makes this transition, in step 324 a log entry is made and a status change is made to the at plant state.

Figure 5B:
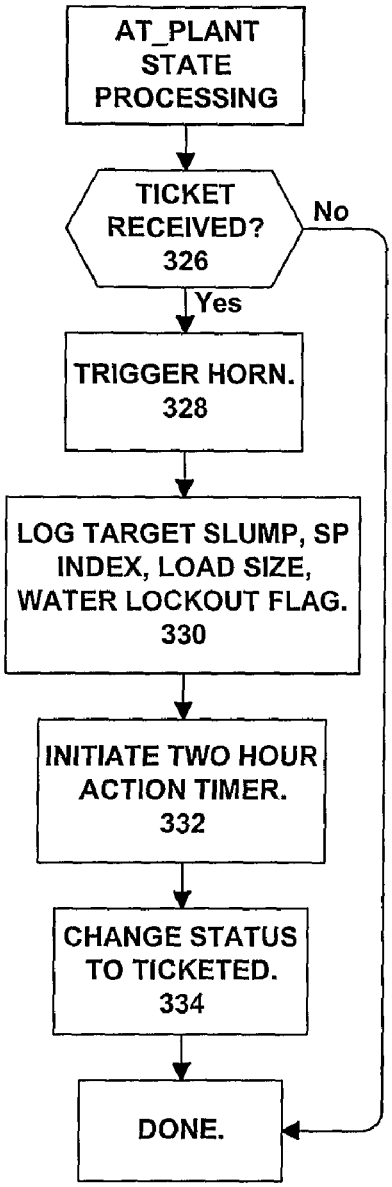

Referring now to FIG. 5B, processing in the at plant state can be described. In the at plant state, the concrete truck is waiting for a job ticket. In step 326, it is determined whether a ticket has been received. If so, then in step 328 the horn is triggered and in step 330 the relevant statistics from the ticket are logged, including the target slump value, super plasticizer index, the load size, and the water lockout mode flag. The water lockout flag is a flag that may be used to lockout the automatic addition of water to the load in several modes, i.e., lockout water added by the ready slump processor, lockout the manual addition of water by the driver, or both.

After a ticket has been logged, in step 332 a two-hour action timer is initiated, which ensures that action is taken on a ticket within two hours of its receipt by the vehicle. Finally, in step 334 the ready slump processor state is changed to ticketed.

Figure 5C:
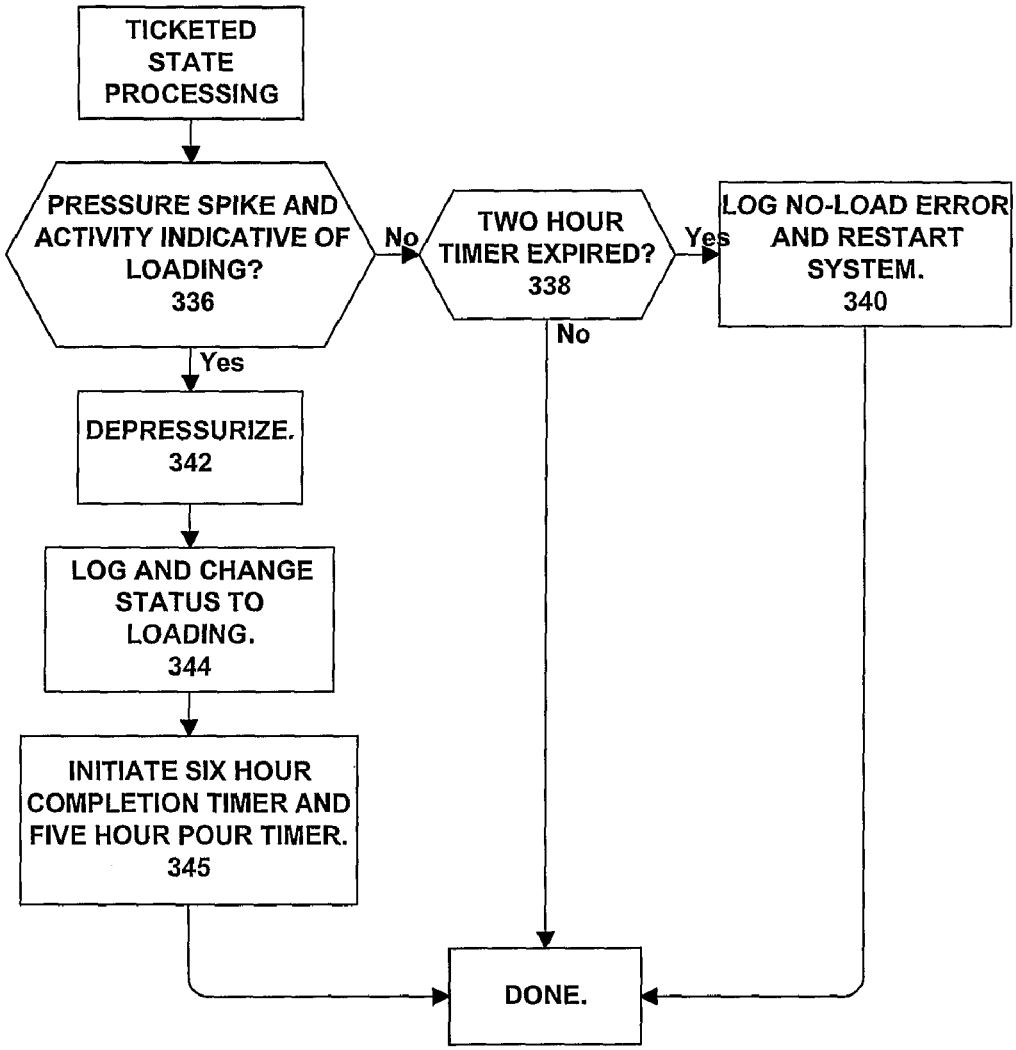

Referring now to FIG. 5C, processing while in the ticketed state can be to explained. In the ticketed state, the concrete truck is waiting to load concrete for a ticketed job. In step 336, therefore, the ready slump processor monitors for a pressure spike in the drum motor pressure, combined with drum rotation in the charge direction at greater than 10 RPM, and no motion of the truck, which are collectively indicative of loading of concrete. In the absence of such a pressure spike, loading is assumed to not have happened, and in step 338 it is determined whether the two-hour activity timer has expired. If the timer expires, in step 340 a no load error is logged, and the system is restarted. If the two-hour timer does not expire then ticketed state processing is completed until the next pass through the main loop of FIG. 4.

If a pressure spike is detected in step 336, then in step 342 the water system is depressurized if need be, since concrete loading will also involve refilling of the water and super plasticizer tanks of the concrete truck, which will need to be depressurized. In step 344, a status change to loading is logged, and that status is then applicable to further actions of the concrete truck. In step 345, a six-hour completion timer is initiated in step 364 as is a five-hour pour timer.

Figure 5D:
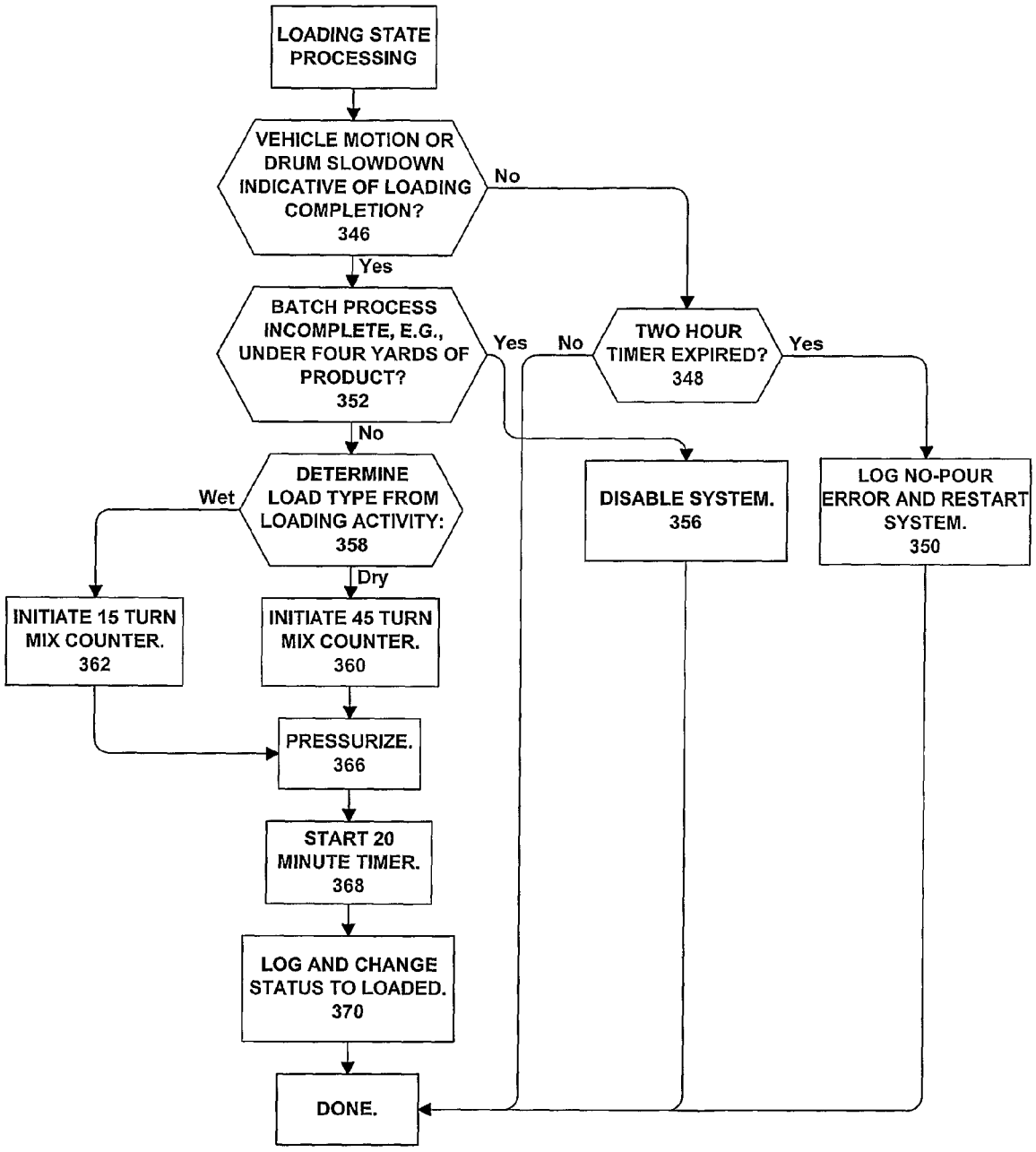

Referring now to FIG. 5D, processing in the loading state can be elaborated. In the loading state, the concrete truck is loaded with concrete and the ready slump processor seeks to detect completion of loading. In step 346 the ready slump processor determines whether there is vehicle motion or the slowdown of the drum rotation, either which is indicative of completed loading of concrete. If neither occurs, it is assumed that loading is continuing and processing continues to step 348 in which the two-hour timer is evaluated, to determine if loading has been completed within the required time frame. If the two-hour timer expires, then a no-pour error is logged in step 350. If, in step 346, vehicle motion or a slowdown of rotation is detected, this is taken as indicating that loading of the concrete truck is completed and processing continues to step 352. In step 352 the ticket for the load and available data are evaluated to determine whether the batch process for loading the truck is complete. This may involve, for example, determining from the ticket or from a load cell signal, or both, whether less than four yards of product have been loaded into the truck, or whether the amount registered by the load cell approximately equals the amount ticketed. In the event that an incomplete batch has been loaded, or in the case where the amount loaded is less than four yards, in step 386 the ready slump system is disabled.

If the available data collected indicate a complete batch of concrete has been loaded in the concrete truck, then in step 358 the ready slump processor evaluates loading activity collected to determine the type of load that has been placed into the drum. If the loading activity indicates that a dry load has been loaded in the drum, then a 45 turn mix counter is initiated in step 360. If the loading activity indicates that a wet load has been placed in the drum, then a 15 turn mix counter is initiated in step 362. The evaluation of whether a whether a wet or dry batch has been loaded into the truck is based on the way the truck was loaded. Specifically, the total amount of time to load the truck is computed, using increases in motor hydraulic pressure as indicative of loading, or alternatively using vibrations detected by an accelerometer attached to the drum or truck as indicative of continuing loading. A premixed or wet load of concrete may be loaded substantially faster and therefore a short load time is indicative of a wet load of concrete, whereas a dry load of unmixed concrete is loaded more slowly and therefore a long load time is indicative of a dry load.

After initiation of the mix counter in step 360 or step 362, in step 366 the water system is pressurized, so that water will thereafter be available for manual or automatic slump management of the concrete load. Next in step 368, a 20 minute timer is initiated, which is used to arm the automatic water system 20 minutes after loading. Finally, and step 370 a status change is logged reflecting that the truck is now loaded and the status of the truck is changed to loaded.

Figure 5E:
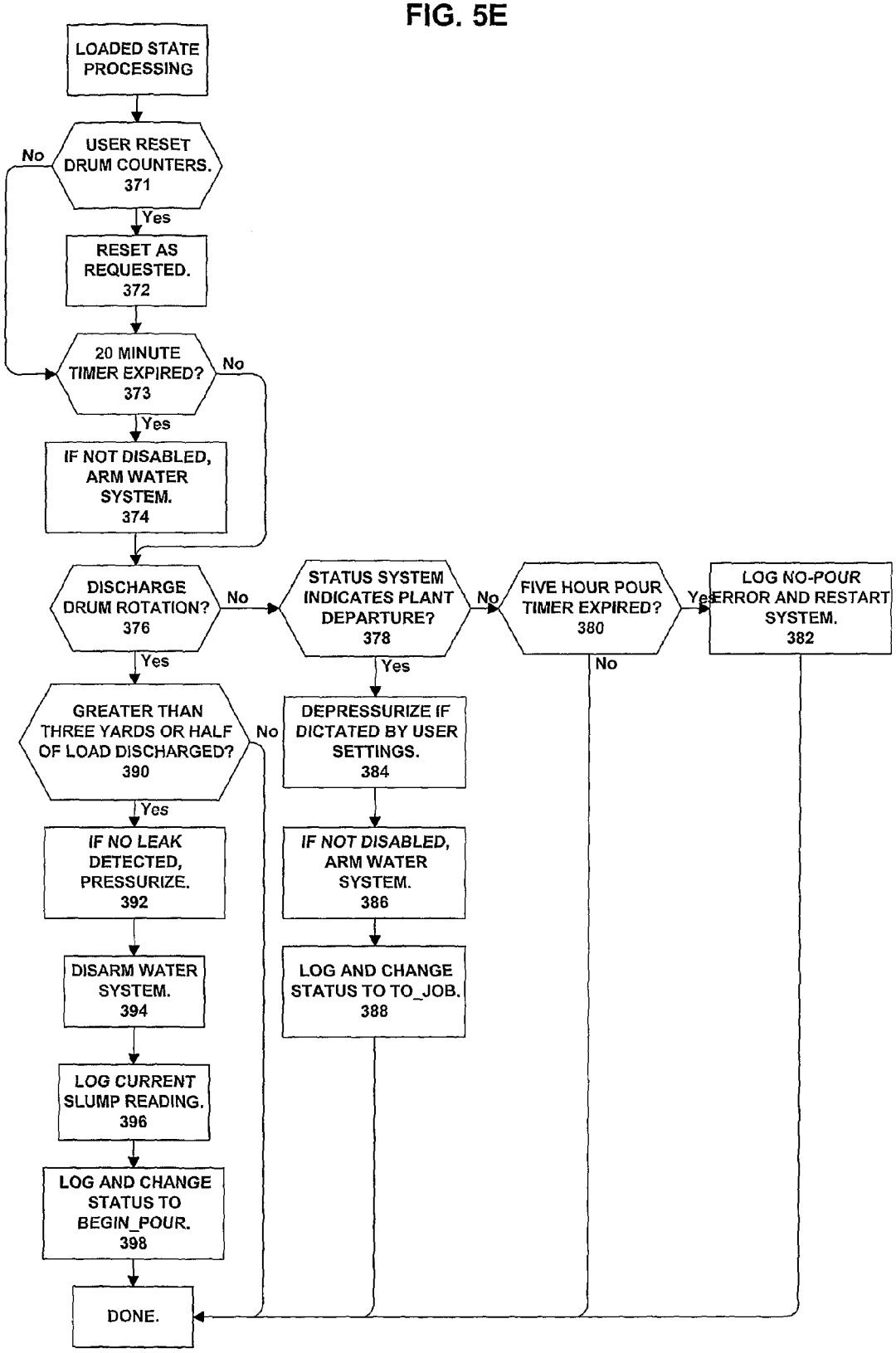

Referring now to FIG. 5E, the processing of the ready slump processor in the loaded state can be explained.

In the loaded state, the user may elect to reset the drum counters, if for example the loading sequence has been done in multiple batches or the drum has been emptied and reloaded, and the operator desires to correct the drum counters to accurately reflect the initial state of the load. If a counter reset is requested in step 371, in step 372 the requested reset is performed.

In step 373, it is determined whether the 20 minute timer for arming the water system, initiated upon transition from the loading state, has expired. When this timer expires, in step 374, the water system is armed (so long as it has not been disabled) so that automatic slump management will be performed by the water system.

The ready slump processor in the loaded state continuously evaluates the drum rotation direction, so that discharge drum rotation indicative of pouring will be detected. In the absence of discharge direction drum rotation, as determined in step 376, the ready slump processor proceeds to step 378, and determines whether the status system has indicated that the truck has departed from the plant. This may be indicated by the operator manually entering status information, or may be indicated by the GPS location of the truck as detected by the status system. If the truck has not left the concrete plant than processing continues to step 380 in which the five-hour timer is evaluated. If that timer has expired then step 382 an error is logged.

Once the truck does leave the plant, in step 384 the water system may be the depressurized, depending upon user settings configuring the ready slump processor. Thereafter in step 386 the water system will be armed (if it has not been disabled) to enable continuing management of concrete slump during travel to the job site. Finally in step 388, a status change is logged in the status of the ready slump processor is changed to the to_job state.

Returning to step 376, if drum rotation in the discharge direction is detected, this indicates that concrete is being discharged, either at the job site, or as part of adjusting a batch of concrete at the plant, or testing a batch of concrete at the plant. Since not all discharges indicate pouring at the job site, initially, an evaluation is made whether a large quantity of concrete has been discharged. Specifically, in step 390 it is determined whether greater than three yards of concrete, or greater than half of the current load of concrete in the drum, have been discharged. If not, then the concrete truck will remain in the loaded state, as such a small discharge may not be related to pouring at the job site. Once a large enough quantity of concrete is discharged, however, then it is assumed that the concrete truck is pouring concrete at the job site, even though movement of the truck to the job site has not been captured by the status system (potentially because the job site is very close to the concrete plant, or the status system has not operated properly).

When it is determined that pouring at the job site has begun, in step 392 the water system is pressurized (if no leak has been flagged), to permit the use of water for truck cleaning, as part of the concrete pour operation. Then in step 394 the water system is disarmed to terminate the automatic addition of water for slump management. Then in step 396 the current slump reading is logged, so that the log reflects the slump of the concrete when first poured. Finally in step 398, a state change is logged and the state of the ready slump processor is changed to the begin pour state.

Figure 5F:
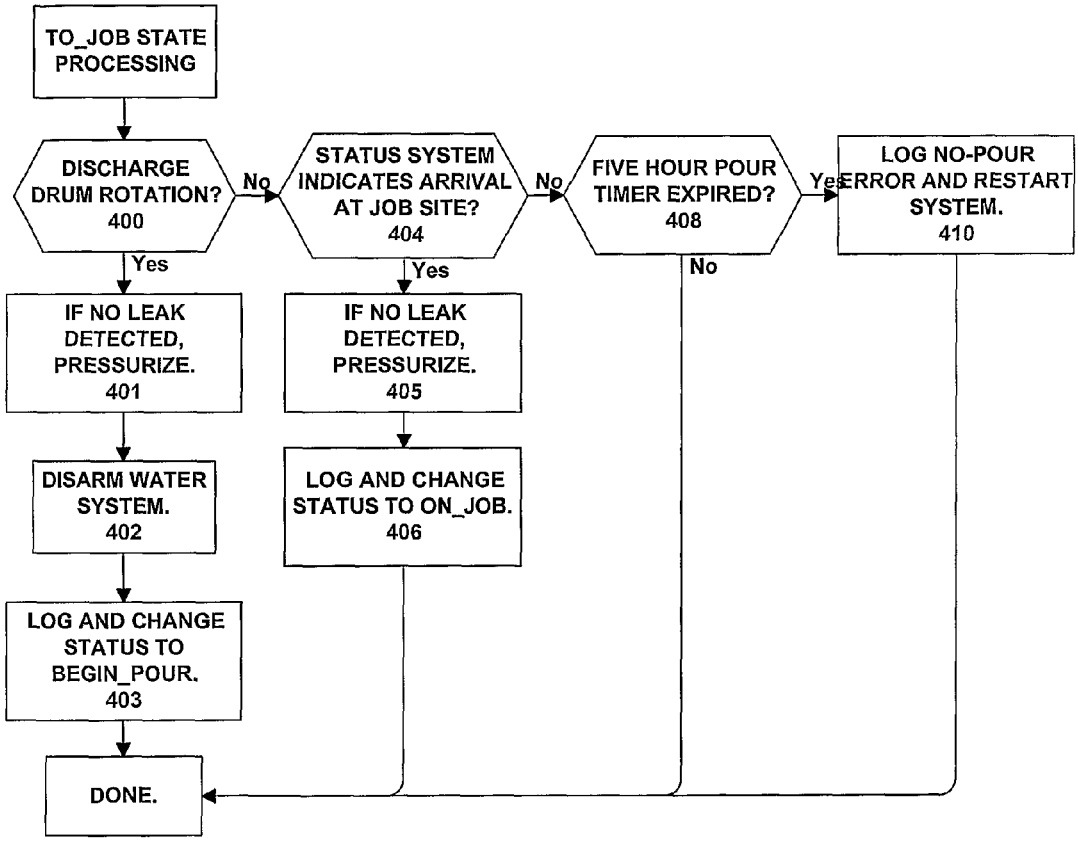

Referring now to FIG. 5F, the processing of the ready slump processor in the to_job state can be explained. In the to job state, the ready slump processor monitors for arrival at the job site as indicated by the status system, or for discharge of concrete, which indirectly indicates arrival at the job site. Thus in step 400, it is determined whether the drum is rotating in the discharge direction. If so, in step 401 the water system is pressurized (if no leak has been detected) to cleanup after pouring at the job site, and in step 402 the automatic addition of water is disarmed. Then in step 403 a log entry is generated and the status of the ready slump processor is changed to the begin_pour state.

Arrival at the job site according to the status system, even in the absence of drum rotation, indicates transition to the on_job state. Therefore, in step 404, if the status system indicates arrival at the job site, then in step 405 the water system is pressurized (if no leak has been detected), and in step 406 a state change is logged and the state of the ready slump processor is changed to the on_job state.

In the event that neither of the conditions of step 400 or 404 are met, then in step 408 it is determined whether the five-hour timer has expired. If so, then in step 410 an error is logged and the system is restarted; otherwise, the ready slump processor remains in the to_job state and processing is completed until the next pass through the main loop of FIG. 4.

Figure 5G:
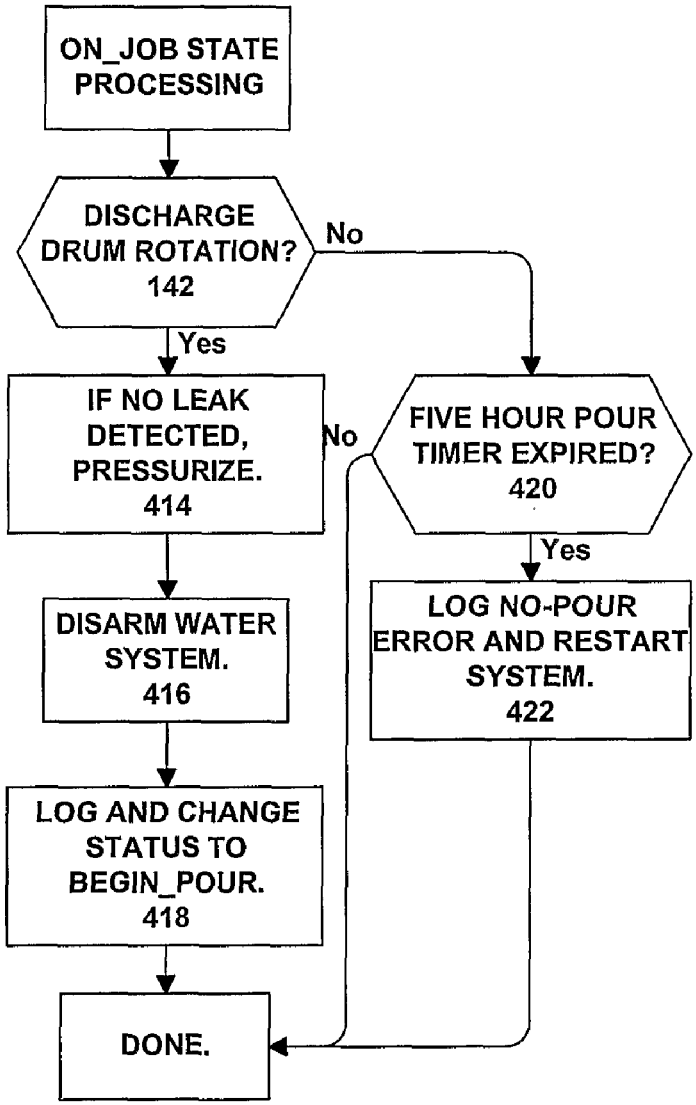

Referring now to FIG. 5G, processing in the on job state can be explained. In the on job state, the ready slump processor monitors for drum rotation indicative of discharge of concrete. In step 412, it is determined whether there is drum rotation in the discharge direction. If so, then in step 414 the water system is pressurized (if no leak has been detected) to facilitate concrete pouring operations, and in step 416 the automatic adding of water is disarmed. Finally, in step 418, the state change is logged and the state of the ready slump processor is changed to the begin_pour state.

If in step 412 discharge drum rotation is not detected, then the system will remain in the on job state, and in step 420, the five-hour timer is evaluated. If the five-hour timer expires then in step 422 in error is generated and the system is restarted.

Figure 5H:
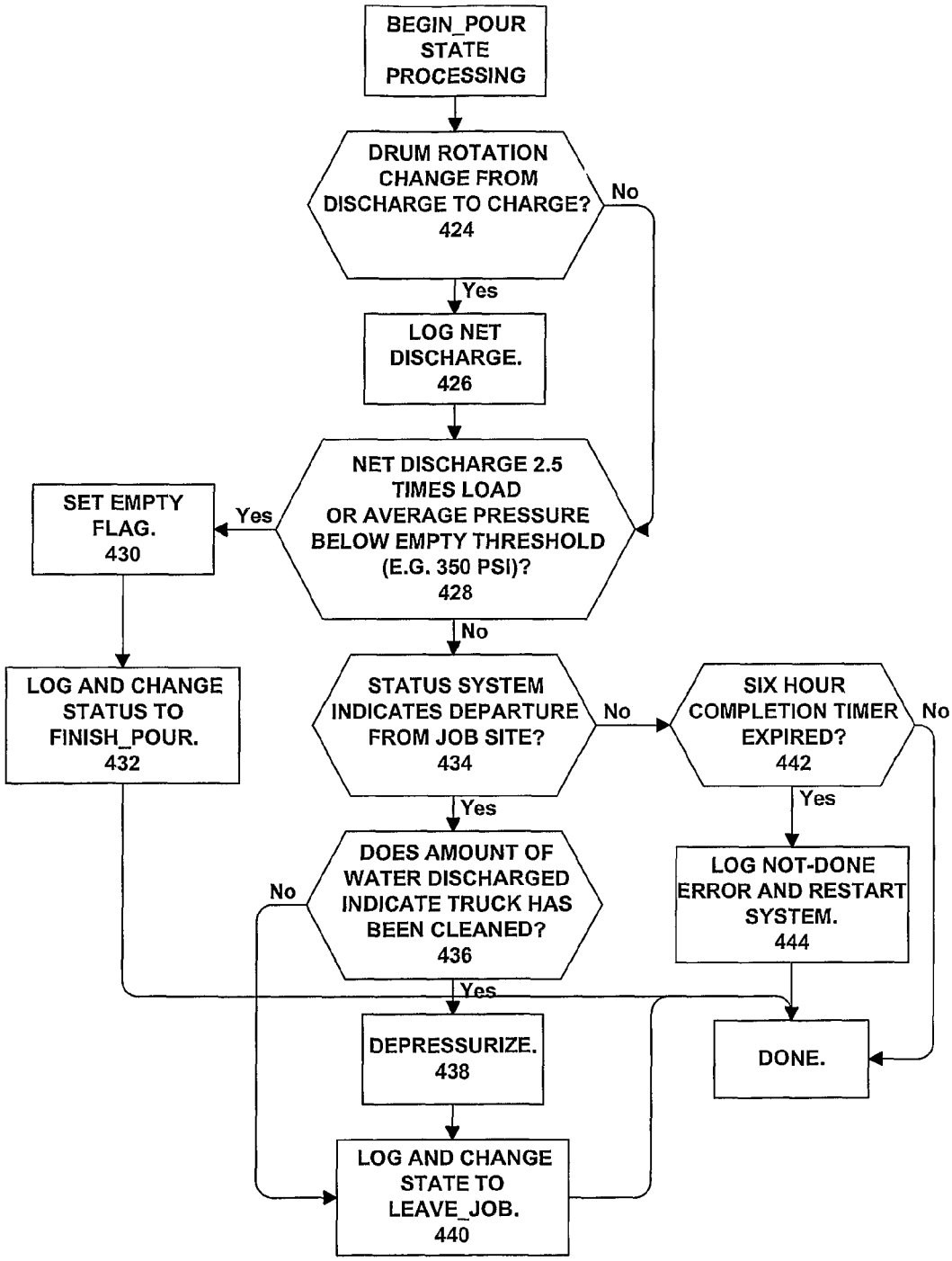

Referring other FIG. 5H, processing in the begin pour state can be explained. The ready slump processor monitors drum rotations in the begin pour state to track the amount of concrete poured at the job site. This is done by initially evaluating, in step 424, whether the drum rotation direction has changed from the discharge direction to the charge direction. If the drum rotation changes direction, then a known amount of concrete has been poured. Thus, in step 426, the net amount of concrete discharged is computed, based on the number of drum turns while the drum was rotating in the discharge direction, and this amount is logged, as is discussed in detail above. The net discharge calculation performed in step 426 can most accurately identify the amount of concrete poured from the drum, by computing the number of discharge turns of the drum, reduced by three-quarters of a turn, as is elaborated above.

After this discharge amount tracking, an evaluation can be made to determine whether the drum has been emptied, as set forth in step 428. Specifically, the drum is considered emptied when the net discharge turns would discharge 2½ times the measured amount of concrete in the load. The load is also considered emptied when the average hydraulic pressure in the drum motor falls below a threshold pressure indicating rotation of an empty drum, for example 350 PSI. If either of these conditions is met, the drum is considered to be empty, and in step 430 a flag is set indicating that the concrete truck is empty. In addition, in step 432, a status change is logged and the state of the ready slump processor changes to the finish pour state.

If the conditions in step 428 are not met, then the drum is not considered to be empty. In such a situation, the ready slump processor evaluates, in step 434, whether the concrete truck has departed from the job site. If so, then ready slump processor proceeds to step 436, in which a determination is made, based on total water flow detected, whether the truck has been cleaned. If the amount of water discharged, as measured by the ready slump processor statistics, indicates that the truck has been cleaned, than in step 438, the water system is depressurized. Next, because departure from the job site requires change of state of the ready slump processor, processing proceeds from step 438, or step 436, to step 440 in which a change of state is logged, and the ready slump processor is changed to the leave_job state.

In the absence of an empty drum condition, or departure from the job site, the ready slump processor will remain in the begin_pour state. In these conditions, the six-hour completion timer 442 is evaluated, and if completion is not been indicated within that six-hour time period then in step 444 an error is logged and the system is restarted.

Figure 5I:
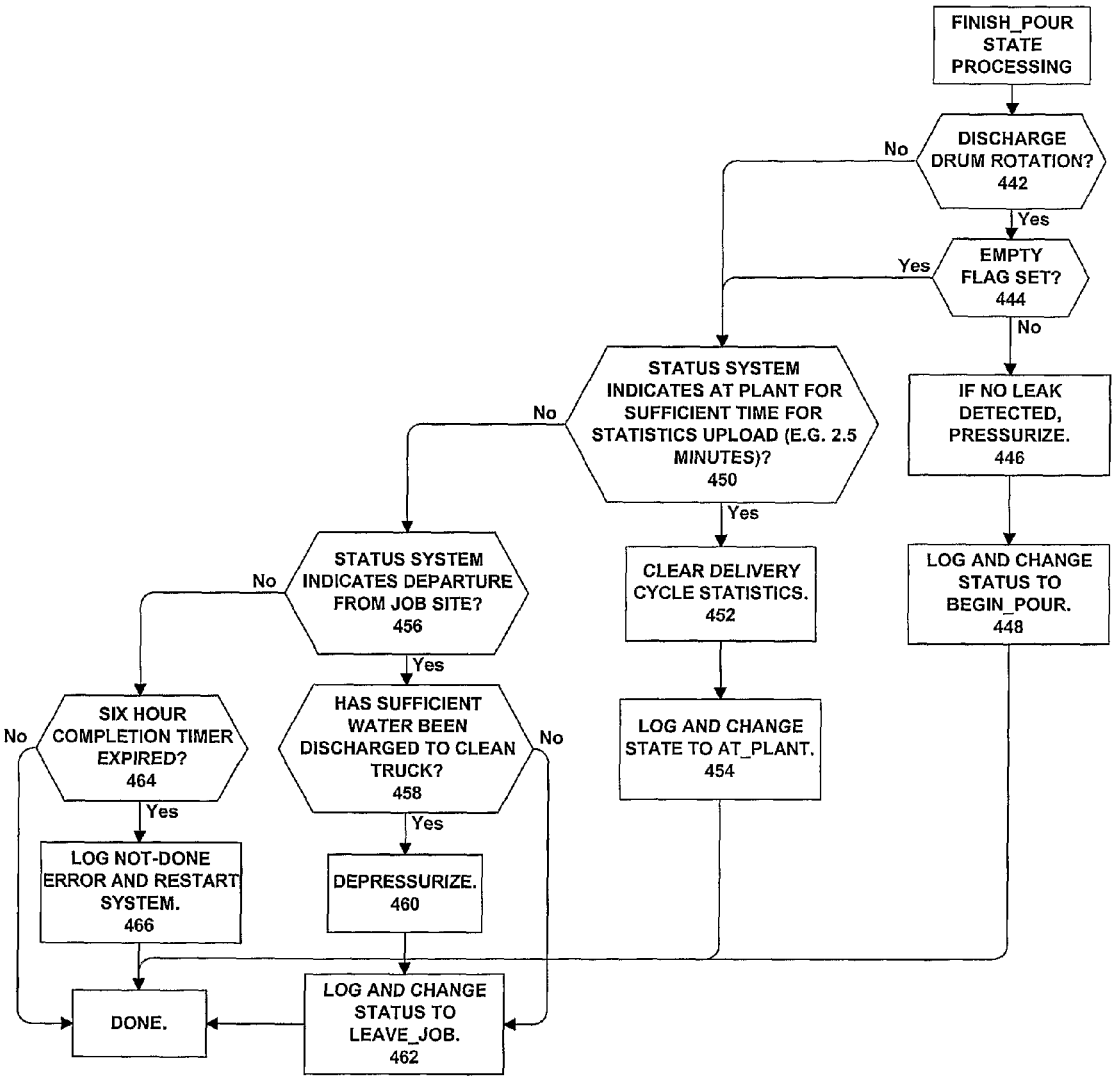

Referring other FIG. 5I, processing in the finish pour state can be explained. In the finish pour state, the ready slump processor monitors concrete truck activity, for activity indicating that concrete pouring has recommenced, and also responds to status system indications that the truck has returned to the plant. For the former purpose, in step 442 it is determined whether the drum is rotating in the discharge direction. If so, it is determined in step 444 whether the drum is considered empty, based upon the flag that may have been set in step 430 of FIG. 5H. If discharge drum rotation is detected and the drum is not empty, then in step 446 the water system is pressurized (if no leak has been detected), and in step 448 a state change is logged and the state of the ready slump processor is returned to the begin_pour state.

If the conditions of steps 442 or 444 are not met, then the ready slump processor evaluates status system activity to determine whether the concrete truck has returned to the plant. In step 450, it is determined whether the status system has indicated that the concrete truck is at the plant, and that there has been sufficient time for statistics from the previous job cycle to be uploaded. This time period may be for example 2½ minutes. If the status system indicates that the concrete truck is at the plant and there has been sufficient time for statistics to be uploaded to the central dispatch office, then processing continues to step 452, and all delivery cycle statistics are cleared, after which a state change is logged in step 454 and the state of the ready slump processor is returned to the at_plant state, to begin a new delivery cycle.

If the concrete truck is not yet arrived at plant, but has left the job site, this activity is also detected. Specifically, in step 456, if the status system indicates that the concrete truck has left the job site, then in step 458 it is determined whether sufficient water has been discharged from the water system to indicate that the truck was cleaned while at the job site. If so, than water should not be needed, and in step 460 the water system is depressurized. If sufficient water has not yet been discharged for cleaning of the truck, it is assumed that water will be needed to clean truck at some other location than the job site, and water system is not depressurized. After step 458 or 460, in step 462 a state change is logged and the status of the ready slump processor is changed to the leave_job state.

If the concrete truck does not leave the job site in the finish pour state, then the ready slump processor will remain in the finish pour state. In this condition, processing will continue to step 464, in which the six-hour completion timer is assessed to determine if this timer has expired. If the completion timer expires than in step 466 an error is logged and the system is restarted.

Figure 5J:
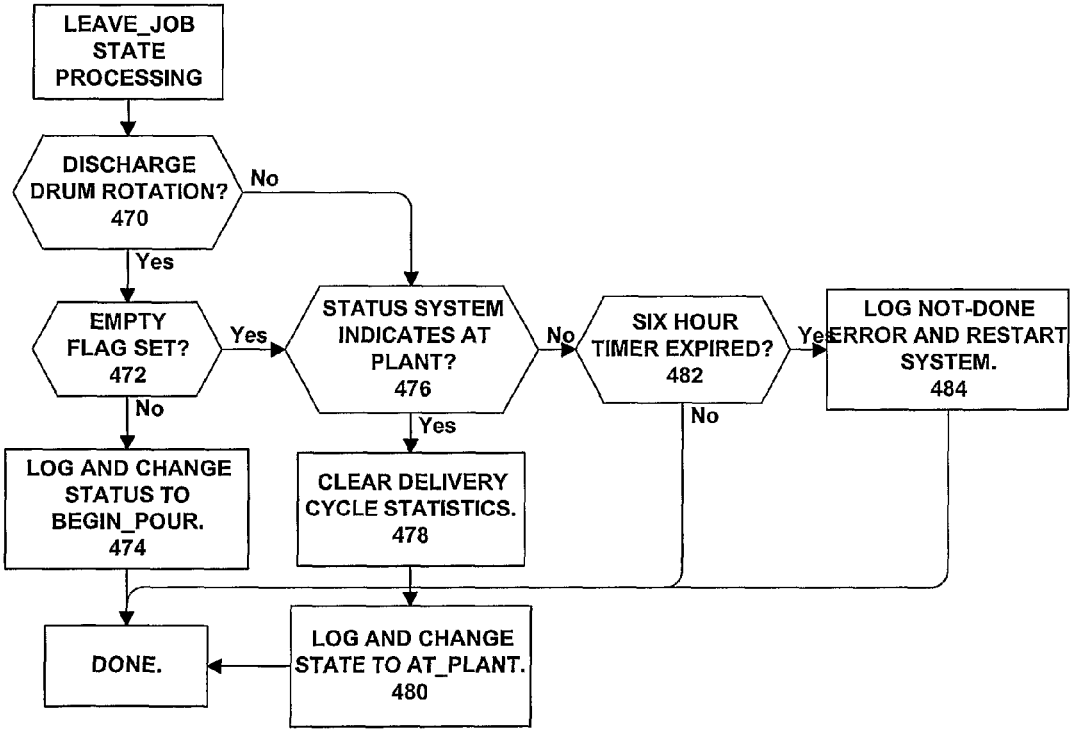

Referring now to FIG. 5J, processing in the leave_job state can be explained. In the leave job state, the ready slump processor monitors for arrival at the plant, or discharge of concrete indicative of further pouring of concrete at a job site. Thus, in step 470, the ready slump processor monitors for discharge direction drum rotation. If discharge drum rotation is detected in step 472, it is determined whether the drum is considered empty, based on the empty flag which can be set in step 430 of FIG. 5H. If the drum is not considered empty, then in step 474 a state change is logged, and the ready slump processor is changed to begin_pour state. If, however, the drum is considered empty (and may be in the process of being cleaned), or if the concrete drum does not rotate in the discharge direction, then processing continues to step 476.

In step 476 the ready slump processor evaluates status system communication, to determine whether the concrete truck has returned to the plant. If the status system indicates that the concrete truck has returned to the plant, the delivery cycle statistics are cleared and, in step 480, a state change is logged and the state of the ready slump processor is changed to the at_plant state, ready for another delivery cycle.

If no further pouring of concrete and no return to the plant occur in the leave_job state, the ready slump processor will remain in the leave job state, and, in this condition, processing will continue to step 482 in which the six-hour timer is evaluated. If the six-hour timer expires, then in step 444 an error is logged and the system is restarted.

As noted above, various statistics and parameters are used by the ready slump processor in operation. These statistics and parameters are available for upload from the processor to the central office, and can be downloaded to the processor, as part of a messaging operation. Some values are overwritten repeatedly during processing, but others are retained until the completion of a delivery cycle, as is elaborated above. The statistics and parameters involved in a specific embodiment of the invention, include the following:

---

Serial Number MSW (most significant word)
Serial Number LSW (less significant word)
Firmware Rev
"SP Installed (0 No, !0 Yes)" (is superplasticizer available on truck)
Maximum Slump Variance (plus/minus 1/24 inch units) range 0 –> 240
Drum Delay Index (in 1/36 turn units) (Typically 22) range 0 –> 108
Drum Index (in 1/10 cubic yards poured per Reverse turn) (Typically 8) range 1 –> 50
Water flow meter calibration (in ticks per gallon) range 1 –> 4095
SP flow meter calibration (in ticks per gallon) range 1 –> 4095
Minimum Loaded Pressure (in psi) - The amount of pressure on the hydraulic cylinder required to transition from the At Plant to Loading state (Typically 300–850) range 1 –> 4000
Minimum # of Fwd Revolutions (in 1/36 turn units) required after dry load range 0 –> 3564
Minimum # of Fwd Revs (in 1/36 turn units) required after addition (Typically 540) range 0 –> 1800
% of target water to add when # of gallons have been calculated to attain desired slump (Typically 80%) range 0 –> 200

-continued

Amount of water (in 1/10 gallon units) to add after addition of superplasticizer to flush the line (Typically .2 gallons) range 0 –> 50
# of minutes in LOADED state to suspend automatic water handling ("Auto Slumper") (Typically 20) range 0 –> 120
"Wireless Drum Installed (0 No, !0 Yes)" indicates whether a wireless system has been installed for drum rotation monitoring
Empty Drum Motor Hydraulic Pressure (in psi) - used to determine Finish Pour (Typically 450) range 0 –> 1000
Pressure Lag Time (in seconds) - duration of charge required before pressures are considered valid (Typically 15) range 0 –> 120
Empty Safety (in 10 percent units) -- percent of load poured that will cause a transition to Finish_Pour state (Typically 25) range 1 –> 100
Inactivity No Load - number of minutes before an inactivity error will occur due to failure to load while ticketed (Typically 120) range 0 –> 240
Inactivity No Pour - number of minutes to keep a ticket after load but with no a pour detection (Typically 300) range 0 –> 480
Inactivity No Done - number of minutes to keep a ticket after load (Typically 360) range 0 –> 720
Flow Evaluation Interval (in seconds) (Typically 15) range 10 –> 120
Water Flow On/Off boundary (Typically 50) in hundredths of a gal per min range 0 –> 255
Sp Flow On/Off boundary (Typically 25) in hundredths of a gal per min range 0 –> 255
Number of pulses per turn of the drum (Typically 9) range 1 –> 360
Resolution used to measure time elapsed between drum pulses in 1/10 ms units (Typically 656) range 10 –> 4000
Ticket arrival activates Horn (0 No, !0 Yes)
Rpm Correction (in psi) (P = Raw + X * (Rpm - 2)) (X is Typically 30) range 0 –>100
Wet/dry batch load time boundary (Typically 80) in seconds range 0 –> 120
Depressurize while in To Job status (0 No, !0 Yes)
Set Water Lock-Out Mode (disable automatic water management) on arrival at job site (0 No, !0 Yes)
Amount of hose water (in 1 gallon units) that will be treated as indicating the truck was cleaned (Typically 5) range 0 –> 120
Inactivity Air - number of minutes to maintain unused air pressure outside of a delivery cycle (Typically 150) range 0 –> 720, 0 means never turn off
Travel Speed mph (Typically 25) range 5 –> 100 - maximum allowed travel speed
Restore Factory Defaults
Truck Status Input (as perceived by truck computer) may be one of the following - 0 Unknown, 1 In Service, 2 Load, 3 Leave Plant, 4 Arrive Job, 5 Begin Pour, 6 Finish Pour, 7 Leave Job, 8 At Plant, 9 Out of Service (returns a Modbus Nak on invalid status change)
Water Lock-Out Mode (0 = None, 1 = All, 2 = disable automatic water)
SP Index - amount of SP required to change the slump of a cubic yard of concrete by one inch (in ounce units)
Total concrete Loaded (in 1/10 cubic yard units)
Target Slump (in 1/24 inch units)
Ticket Present (0 No, !0 Yes)
Horn State
Horn State Duration (in seconds, 0 means forever) The horn will be set to the Horn State for this number of seconds. This value is decremented every second. The Horn State is toggled when this register reaches zero.
Truck Speed (mph)
Truck Latitude MSW (in $1/10^{e7}$ degree units)
Truck Latitude LSW
Truck Longitude MSW (in $1/10^{e7}$ degree units)
Truck Longitude LSW
At Plant (GPS based not Status) (0 No, !0 Yes)
Manual Add Water (in 1/10 gallon units) range 0(Stop) –> 999
Manual Add SP (in ounce units) range 00(Stop) –> 999
Secondary Load size (in 1/10 cubic yard units)
Air Override (0 = No Action, 1 = Pressurize, 2 = Depressurize) state persists until a new event occurs which normally adjusts the air state
Clear Drum Counts(0 No Action, !0 Clears)
Test Mode (0 = No Action, 1 = Enter Test Mode, 2 = Exit Test Mode)
Local (internal) Display Text Live Time (in seconds) This timer allows the status system computer to temporarily take control of the internal display. The Live Time is decremented every second and when it reaches zero the Ready Slump Processor regains control of the display contents.
Local (internal) Display Text - Two left most digits
Local (internal) Display Text - Two right most digits
Ready Slump Processor Mode - (0 = Disabled, 1 = Automatic, or 2 = Rock Out) This is an indicator of whether or not the Ready Slump Processor has everything it needs to perform the slumping operation. To transition to automatic mode the ticket must be present, the truck must be at the plant, and the truck status must be loaded. If a reverse turn occurs in the yard after a delivery cycle the mode will change to Rock Out
Slumper Control - 0 - Manual, 1 - Dry Mix, 2 - Hold Off, 3 - Waiting, 4 - Adding, 5 - Mixing"
Truck Status Output (as perceived by Ready Slumper) may be one of the following - 0 Unknown, 1 In Service, 2 Load, 3 Leave Plant, 4 Arrive Job, 5 Begin Pour, 6 Finish Pour, 7 Leave Job, 8 At Plant, 9 Out of Service
Concrete on Ground (in 1/10 cubic yard units) - capped at load size
Total Charge Revs (in 1/36 turn units) - number of forward turns since entering Load status
Total Discharge Revs (in 1/36 turn units) - number of reverse turns since entering Load status
Number of Begin Pours
Total Water Use (in 1/10 gallon units)
Total SP Use (in ounce units)
Current Slump (in 1/24 inch units) *255 means never calculated
Slump Display is frozen due to inability to currently calculate slump (i.e. the truck was never loaded, the drum is spinning too fast, sp was added)
Full Load - Mixer has been loaded and no concrete has been discharged
# of seconds in Finish Pour status
Total Hose Water (in 1/10 gallon units) - water dispensed while still
Total Manual Water Added (in 1/10 gallon units) - water added thru register 215
Total Automatic Water Added (in 1/10 gallon units)
Total Leak Water Added (in 1/10 gallon units) - water lost while moving
Total Leak SP Added (in ounce units) - SP not added thru 216
Drum Direction (0 = Pause, 1 = Charge, 2 = Discharge)
Drum Rotation Rate in (1/36 turn units per minute) (only meaningful when direction = Charge)
Mix Rate (0 = OK, 1 = Slow, 2 = Fast) (only meaningful when Loaded and Direction = Charge)
Mix Revs (only meaningful when is mixing)
Empty (0 No, !0 Yes)
Load Time (in seconds) - time between Load and Empty
Seconds since commission MSW - reading this register locks in the LSW value
Seconds since commission LSW
Component Alarm (0 No, !0 Yes)
Number of Communication Errors
Air On (0 No, 10 Yes)
Water On (0 No, !0 Yes)
Sp On (0 No, !0 Yes)
Water No Flow (0 No, !0 Yes)
Water No Stop
Sp No Flow (0 No, !0 Yes)
Sp No Stop
Number of Hard Resets
Number of Soft Resets
Raw Hydraulic Pressure in PSI
Mix Hydraulic Pressure in PSI
Current Flow Water Tick
Current Flow Sp Tick
Flow Flags
Target Flow Water Tick
Target Flow Sp Tick
Concrete on Ground Raw
Drum Stable (0 No, !0 Yes)
Slump Currently Known (0 No, !0 Yes)
Slump Ever Known (0 No, !0 Yes)
New Slump Target (in 1/24 inch units) this has no effect on the target slump. It simply calculates the amount of Sp or Water to add, to achieve the target.
Amount of water (in 1/10 gallon units) to add to achieve desired slump -continued Amount of Sp (in ounce units) to add to achieve desired slump
Load Remaining (in 1/10 cubic yard units)
Reset Calculator (!0 restores Slump Target to 205 and Load Remain to LoadSz - Cog)
Number of Records
Log Command // Writing a valid command causes an action 1-Clear, 2-Oldest, 3-Newest, 4-Next, 5-Prev
TimeStamp // Last Record Read MSB
TimeStamp // Next Record (LSB) (advances on read)
Event Kind
Truck Latitude MSW (in $1/10^{e7}$ degree units)
Truck Latitude LSW
Truck Longitude MSW (in $1/10^{e7}$ degree units)
Truck Longitude LSW
Event Data
Total Number of Program Records
Number of Program Records received
Program Live Time (in seconds) - Amount of time allowed to complete program transfer
Commit Program
Program Record Ack Active write the Record number (reading returns 0 no active or 1 active)
Program Record - variable length records are written starting at this address. These records maybe up to 64 bytes(32 registers).
Program Header - 32 registers
Total Number of Key-Val pairs(max 128)
first key
first val
last key
last val
Commit Table - Write in the proper CRC to commit. Reading always returns 0.

While the present invention has been illustrated by a description of embodiments and while these embodiments have been described in some detail, it is not the intention of the Applicants to restrict or in any way limit the scope of the appended claims to such detail. Additional advantages and modifications other than those specifically mentioned herein will readily appear to those skilled in the art.

For example, the status monitoring and tracking system may aid the operator in managing drum rotation speed, e.g., by suggesting drum transmission shifts during highway driving, and managing high speed and reduced speed rotation for mixing. Furthermore, fast mixing may be requested by the ready slump processor when the concrete is over-wet, i.e., has an excessive slump, since fast mixing will speed drying. It will be further appreciated that automatic control of drum speed or of the drum transmission could facilitate such operations.

The computation of mixing speed and/or the automatic addition of water, may also take into account the distance to the job site; the concrete may be brought to a higher slump when further from the job site so that the slump will be retained during transit.

Further sensors may be incorporated, e.g., an accelerometer sensor or vibration sensor such as shown in FIG. 6 may be utilized to detect drum loading as well as detect the on/off state of the truck engine. Environmental sensors (e.g., humidity, barometric pressure) may be used to refine slump computations and/or water management. More water may be required in dry weather and less water in wet or humid weather.

A warning may be provided prior to the automatic addition of water, so that the operator may prevent automatic addition of water before it starts, if so desired.

Finally, the drum management process might be made synchronous to drum rotation, i.e., to capture pressure at each amount of angular motion of the drum. Angular motion of the drum might be signaled by the magnetic sensor detecting a magnet on the drum passing the sensor, or may be signalled from a given number of "ticks" of the speed sensor built into the motor, or may be signaled by an auxiliary processor coupled to a wireless accelerometer based drum rotation sensor. To facilitate such operation it may be fruitful to position the magnetic sensors at angularly equal spacing so that the signal generated by a magnet passing a sensor is reflective of a given amount of angular rotation of the drum.

This has been a description of the present invention, along with the methods of practicing the present invention as currently known. However, the invention itself should only be defined by the appended claims, wherein

We claim:

1. A system for calculating and reporting slump, comprising:

a delivery vehicle having a mixing drum and hydraulic drive for rotating the mixing drum;

a fluid supply and a flow valve coupling said fluid supply to the mixing drum;

a rotational sensor mounted to the mixing drum and configured to sense drum activity in the form of a rotational speed of movement of the mixing drum;

a hydraulic sensor coupled to the hydraulic drive and configured to sense drum activity in the form of a hydraulic pressure required to turn the mixing drum; and a programmable processor coupled to the flow valve, rotational sensor and hydraulic sensor, and a program memory storing a program that causes the processor to compute a slump measure for a mixture within the mixing drum using information from the sensors, wherein the rotational speed of movement of and hydraulic pressure applied to the mixing drum over a period of time are used in determining when mixing is complete and in calculating the slump of the material within the mixing drum, wherein the processor determines whether to discharge fluid into the mixing drum based upon the slump of the material.

2. The system of claim 1, wherein the material within the mixing drum is concrete and the history of the rotational speed of the mixing drum is used to qualify the accuracy of a calculation of current slump.

3. The system of claim 2, wherein the material within the mixing drum is concrete and the stability of rotational speed of the mixing drum is used to qualify the accuracy of a calculation of current slump.

4. The system of claim 1 wherein the material within the mixing drum is concrete and said processor further determines from the sensed rotational speed of or hydraulic pressure applied to the drum, or both, one or more of:

adequacy of mixing of concrete, the occurrence of a concrete pour action from the mixing drum, appropriateness of a concrete discharge from the mixing drum, concrete slump values, the occurrence of a fluid discharge into the mixing drum, appropriateness of a fluid discharge into the mixing drum, effect of a fluid discharge into the mixing drum, water supply conditions.

5. The system of claim 1 wherein said fluid discharged into said drum comprises a chemical additive.

6. The system of claim 1 wherein said chemical additive is a superplasticizer.

7. The system of claim 1 wherein said fluid discharged into said drum comprises water.

8. A system for calculating and reporting slump of concrete in a concrete mixing drum, comprising:

a concrete mixing drum and a hydraulic drive for rotating said concrete mixing drum;

a fluid supply and a flow valve for coupling water or chemical additive supply to said concrete mixing drum;

a rotational sensor mounted to said concrete mixing drum and configured to sense drum activity in the form of a rotational speed of movement of said concrete mixing drum;

a hydraulic sensor coupled to the hydraulic drive and configured to sense drum activity in the form of a hydraulic pressure required to turn said concrete mixing drum; and a programmable processor coupled to said flow valve, said rotational sensor, and said hydraulic sensor; and a program memory storing a program that causes said programmable processor to compute a slump measure for a concrete mixture within said concrete mixing drum using information from said rotational and hydraulic sensors, wherein:

(i) the rotational speed of movement of and hydraulic pressure applied to said concrete mixing drum over a period of time is used by said programmable processor and said program memory in determining when mixing of concrete is complete and in calculating the slump of concrete within said concrete mixing drum;

(ii) the stability of rotational speed of said concrete mixing drum is used by said programmable processor and said program memory to qualify the accuracy of a calculation of current slump of the concrete contained in said concrete mixing drum;

(iii) said programmable processor determines whether to discharge water or chemical additive into said concrete mixing drum based upon the slump of the concrete; and (iv) said processor further determines from the sensed rotational speed of or hydraulic pressure applied to the drum, or both, one or more of: (A) adequacy of mixing of the concrete; (B) the occurrence of a concrete pour action from said concrete mixing drum; (C) appropriateness of a concrete discharge from said concrete mixing drum; (D) concrete slump values; (E) the occurrence of a discharge of water or chemical additive into said concrete mixing drum; (F) appropriateness of a discharge of water or chemical additive into said concrete mixing drum; (G) the effect of a discharge of water or chemical additive into said concrete mixing drum; or (H) water supply conditions.

9. The system of claim 8 further comprising water and chemical additive supplies and flow valves for each of these supplies, said flow valves being connected to said programmable processor.

10. The system of claim 8 wherein said chemical additive is a superplasticizer.

* * * * *